US011325271B2

(12) United States Patent
Tucker et al.

(10) Patent No.: US 11,325,271 B2
(45) Date of Patent: May 10, 2022

(54) SHAVING SYSTEMS

(71) Applicant: SHAVELOGIC, INC., Dallas, TX (US)

(72) Inventors: William E. Tucker, Attleboro, MA (US); Dougals R. Kohring, Arrowsic, ME (US)

(73) Assignee: SL IP COMPANY LLC, Dallas, TX (US)

( * ) Notice: Subject to any disclaimer, the term of this patent is extended or adjusted under 35 U.S.C. 154(b) by 183 days.

(21) Appl. No.: 16/632,102

(22) PCT Filed: Jun. 8, 2018

(86) PCT No.: PCT/US2018/036668

§ 371 (c)(1),
(2) Date: Jan. 17, 2020

(87) PCT Pub. No.: WO2019/018080

PCT Pub. Date: Jan. 24, 2019

(65) Prior Publication Data

US 2020/0223080 A1 Jul. 16, 2020

Related U.S. Application Data

(60) Provisional application No. 62/534,995, filed on Jul. 20, 2017.

(51) Int. Cl.
*B26B 21/52* (2006.01)
*B26B 21/22* (2006.01)

(52) U.S. Cl.
CPC ..... *B26B 21/521* (2013.01); *B26B 21/225* (2013.01)

(58) Field of Classification Search
None
See application file for complete search history.

(56) References Cited

U.S. PATENT DOCUMENTS 4,347,663 A 9/1982 Ullmo
4,756,082 A 7/1988 Apprille, Jr.
5,661,907 A * 9/1997 Apprille, Jr. ..... B26B 21/4012 30/47
5,953,825 A 9/1999 Christman et al.
6,311,400 B1 * 11/2001 Hawes ..... B26B 21/225 30/50

(Continued)

FOREIGN PATENT DOCUMENTS

EP 1531030 B1 10/2007
WO 2016087007 A1 6/2016

OTHER PUBLICATIONS

International Application No. PCT/US2018/036668 International Search Report and Written Opinion dated Aug. 27, 2018.

(Continued)

*Primary Examiner* — Hwei-Siu C Payer
(74) *Attorney, Agent, or Firm* — Leber IP Law; Celia H. Leber

(57) ABSTRACT

Shaving razors and shaving assemblies for wet shaving, including a blade unit pivotably mounted on an interface element, are disclosed. Pivoting of the blade unit is accomplished using a shell bearing arrangement in which the shell bearing member is provided on an interface element. An elastomeric return element is provided to bias the blade unit towards a rest position.

23 Claims, 24 Drawing Sheets

(56) References Cited

U.S. PATENT DOCUMENTS

| | | | | |
|---|---|---|---|---|
| 7,152,512 | B1 | 12/2006 | Prochaska | |
| 8,033,023 | B2 * | 10/2011 | Johnson | B26B 21/225 30/50 |
| 8,166,661 | B2 * | 5/2012 | King | B26B 21/521 30/527 |
| 9,486,930 | B2 * | 11/2016 | Provost | B26B 21/14 |
| 9,623,575 | B2 * | 4/2017 | Griffin | B29C 44/02 |
| 9,630,331 | B2 * | 4/2017 | Griffin | B26B 21/225 |
| 2015/0158192 | A1 * | 6/2015 | Tucker | B26B 21/4068 83/13 |
| 2015/0290819 | A1 | 10/2015 | Giannopoulos et al. | |
| 2017/0036360 | A1 | 2/2017 | Griffin et al. | |
| 2020/0164537 | A1 * | 5/2020 | Tucker | B26B 21/521 |
| 2020/0223080 | A1 * | 7/2020 | Tucker | B26B 21/521 |
| 2020/0223081 | A1 * | 7/2020 | Tucker | B26B 21/225 |

OTHER PUBLICATIONS

European Patent Application No. 18834724.9, Extended European Search Report dated Mar. 25, 2021, 8 pages.
Korean Patent Application No. 10-2020-7004505 Grounds for Rejection dated Jan. 3, 2022, with English Translation, 12 pages.

* cited by examiner

SHAVING SYSTEMS

BACKGROUND

The invention relates to shaving systems having handles and replaceable blade units. Shaving systems often consist of a handle and a replaceable blade unit in which one or more blades are mounted in a plastic housing. After the blades in a blade unit have become dull from use, the blade unit is discarded, and replaced on the handle with a new blade unit. Such systems often include a pivoting attachment between the blade unit and handle, which includes a pusher and follower configured to provide resistance during shaving and return the blade unit to a "rest" position when it is not in contact with the user's skin.

In some cases, pivoting is provided by a "shell bearing" arrangement. The construction of razors with pivoting connecting structures having inner and outer shell bearings is well known in the art. Generally, the shell bearings are at least partially disposed on the handle. In some cases, shell bearings may tend to rattle or "wobble" during shaving.

SUMMARY

The present disclosure pertains to shaving razors having shell bearing units that include interacting features on the interface element and blade unit that provide pivoting of the blade unit relative to the interface element. In some implementations the razors also include an elastomeric return element having a central portion configured to abut a surface of the blade unit and apply a return force to the surface.

In one aspect, the disclosure features a replaceable shaving assembly that includes (a) a blade unit comprising a plurality of longitudinally extending blades; (b) an interface element, configured to removeably connect the blade unit to a handle; (c) a pair of shell bearing units comprising interacting elements on the interface element and blade unit that provide pivoting of the blade unit relative to the interface element; and (d) an elastomeric return element having a central portion configured to abut a surface of the blade unit and apply a return force to the surface, the central portion extending generally parallel to a longitudinal axis of the blade unit, and side portions extending from the interface element and supporting the central portion.

Some implementations include one or more of the following features. The return element may be configured to bias the blade unit towards a rest position with respect to a pivot axis that is generally parallel to a long axis of the blade unit. The return element may include a synthetic elastomer or natural rubber material. In some cases, the shaving assembly further includes a second elastomeric return element, configured to apply a force to the blade unit opposing the return force, which may be integrally formed with or separate from the first elastomeric element. If the two elastomeric elements are formed separately, they may be formed of different materials and/or have different geometries.

Each shell bearing unit may include a shell bearing member extending from the interface element, and in some cases further include a stanchion extending from the blade unit towards the interface element. In such implementations, the stanchion may include a hook, and the shell bearing member may include pivot stop flanges configured to interact with the hook to limit pivoting of the blade unit. Alternatively, the stanchion may include a tooth extending towards the shell bearing member, and the shell bearing member may include a slot configured to receive the tooth, interaction between the tooth and slot limiting pivoting of the blade unit.

In some implementations, the stanchion comprises an elastomeric flex arm, which may include a core of hard plastic material in contact with, e.g., partially or completely surrounded by, an elastomeric material.

In another aspect, the disclosure features a shaving assembly that includes (a) a blade unit comprising a plurality of longitudinally extending blades; (b) an interface element, configured to removeably connect the blade unit to a handle; and (c) a pair of shell bearing units comprising interacting elements on the interface element and blade unit that provide pivoting of the blade unit relative to the interface element. Each of the shell bearing units comprises a shell bearing element extending from the interface element and having a first arcuate surface configured to interact with a corresponding first arcuate surface of the blade unit.

Some implementations include one or more of the following features. The first arcuate surfaces are concentric. The shell bearing element may be disposed on an arm extending from the interface element towards the blade unit. The first arcuate surface of the blade unit may be disposed on a stanchion extending from the blade unit towards the interface element. The shell bearing element may include pivot stops to limit relative rotation of the first arcuate surfaces, for example flanges extending outwardly from the arcuate surface of the shell bearing element, which interact with a hook on the stanchion, or, alternatively, opposite ends of a slot in the concentric, arcuate surface of the shell bearing element, which interact with a tooth on the stanchion that is configured to be received in the slot.

In some implementations each shell bearing unit further comprises a second concentric, arcuate surface, disposed on the shell bearing element, configured to interact with a corresponding second concentric, arcuate surface of the blade unit.

In yet another aspect, the disclosure features a replaceable shaving assembly that includes (a) a blade unit comprising a plurality of longitudinally extending blades; an interface element, configured to removeably and pivotably connect the blade unit to a handle; and (b) a pair of elastomeric return elements extending from the interface element towards the blade unit, each return element having a central portion configured to abut a surface of the blade unit and apply a return force to the surface, the central portion extending generally parallel to a longitudinal axis of the blade unit, and side portions extending from the interface element and supporting the central portion.

Some implementations of this aspect may include one or more of the following features. The return elements may be configured to apply opposing, substantially balanced forces to the blade unit to maintain the blade unit in a rest position in the absence of shaving forces. The return elements may be integrally formed of a single elastomeric material. Alternatively, the return elements may be formed of two different elastomeric materials. In some cases, the central portions of the return elements have different lengths. The return elements may include notches that cradle front and rear edges of the blade unit.

The disclosure also features shaving razors that include the shaving assemblies discussed herein. These razors may include any of the features discussed above.

DESCRIPTION OF THE DRAWINGS

FIG. 9 shows the blade unit in a rest position with the rear rotational flange stop engaged.

(FIG. 10 shows blade unit rotated to a maximum clockwise position, and shows the front rotational flange stops engaged.)

FIG. 19 shows the blade unit in a rest position with the rear tooth stop engaged.

DETAILED DESCRIPTION

Figure 1:
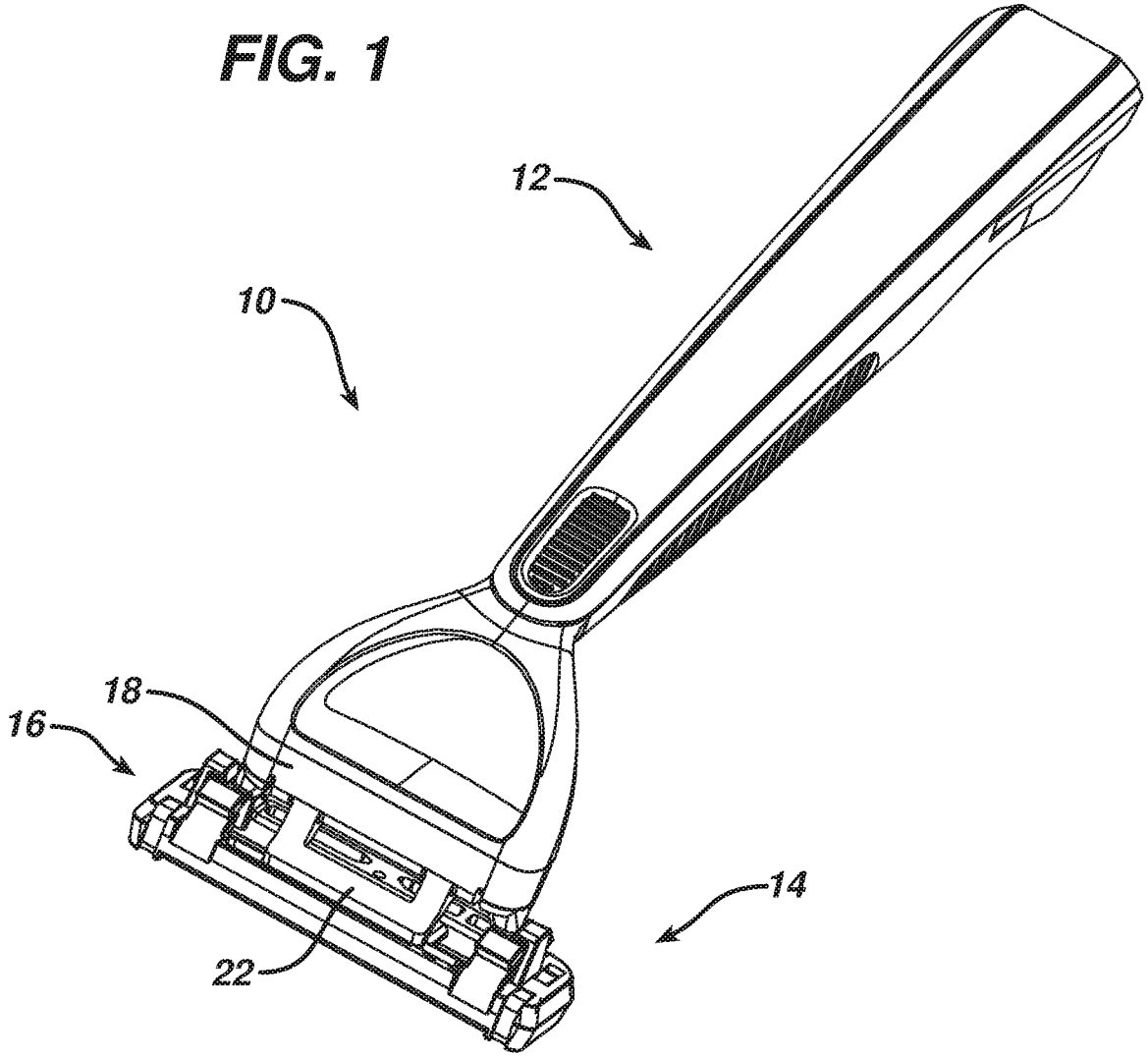
FIG. 1 is a perspective view of a shaving razor according to one implementation.

Referring to FIG. 1, a razor 10 includes a handle 12 and, mounted at a distal end of the handle, a shaving assembly 14. The shaving assembly 14 includes a blade unit 16 pivotably mounted on an interface element 18. The interface element 18 may be mounted on the handle in any desired manner. In some implementations mounting is accomplished using a magnetic attachment system that includes magnetic and ferrous elements. In some implementations, a magnetic element is associated with an appendage (not shown) at the distal end of the handle and a ferrous element is associated with receiving portion 20 (FIG. 2) of the interface element 18, e.g., as disclosed in U.S. Pat. No. 8,789,282, the full disclosure of which is incorporated herein by reference.

The shaving assembly 14 also includes an elastomeric return element 22, which is similar to the elastomeric return element described in U.S. Pat. No. 9,623,575, the full disclosure of which is incorporated herein by reference. The elastomeric return element includes a central portion 24 that extends generally parallel to the longitudinal axis of the blade unit, and abuts a surface of the blade unit to provide a return force to the blade unit after a shaving stroke.

Figure 2:
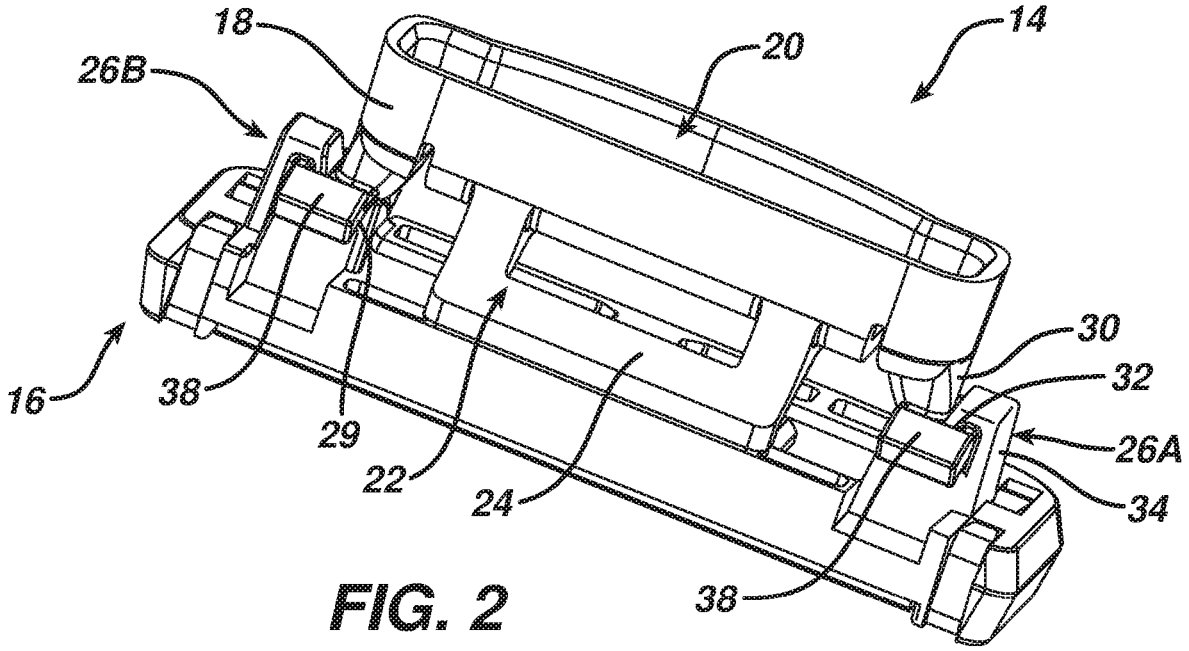
FIG. 2 is a perspective view of the shaving assembly of the razor shown in FIG. 1.
Figure 2A:
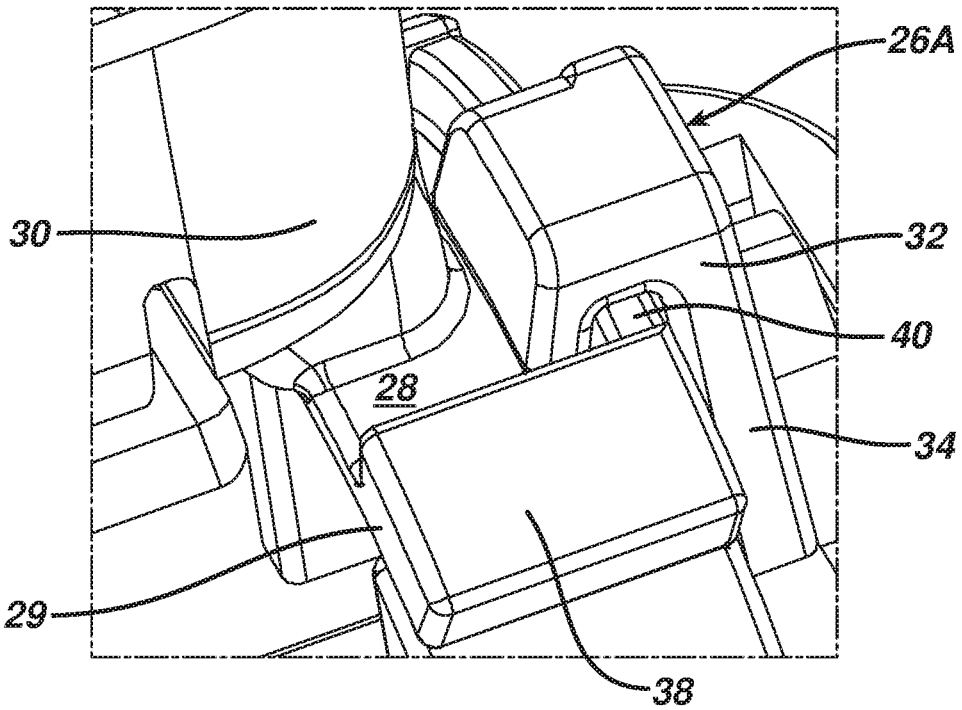
FIG. 2A is an enlarged detail view of an end portion of the shaving assembly shown in FIG. 2.

Referring to FIGS. 2-2A, pivoting of the blade unit is provided by a pair of shell bearing units 26A, 26B, with one shell bearing unit disposed at each end of the shaving assembly. Advantageously, the shell bearing units are provided on the shaving assembly, rather than the handle, and thus are replaced each time the user replaces the shaving assembly, preventing the shaving assembly from being fouled by soap, debris and wear over a long period of use.

Figure 3:
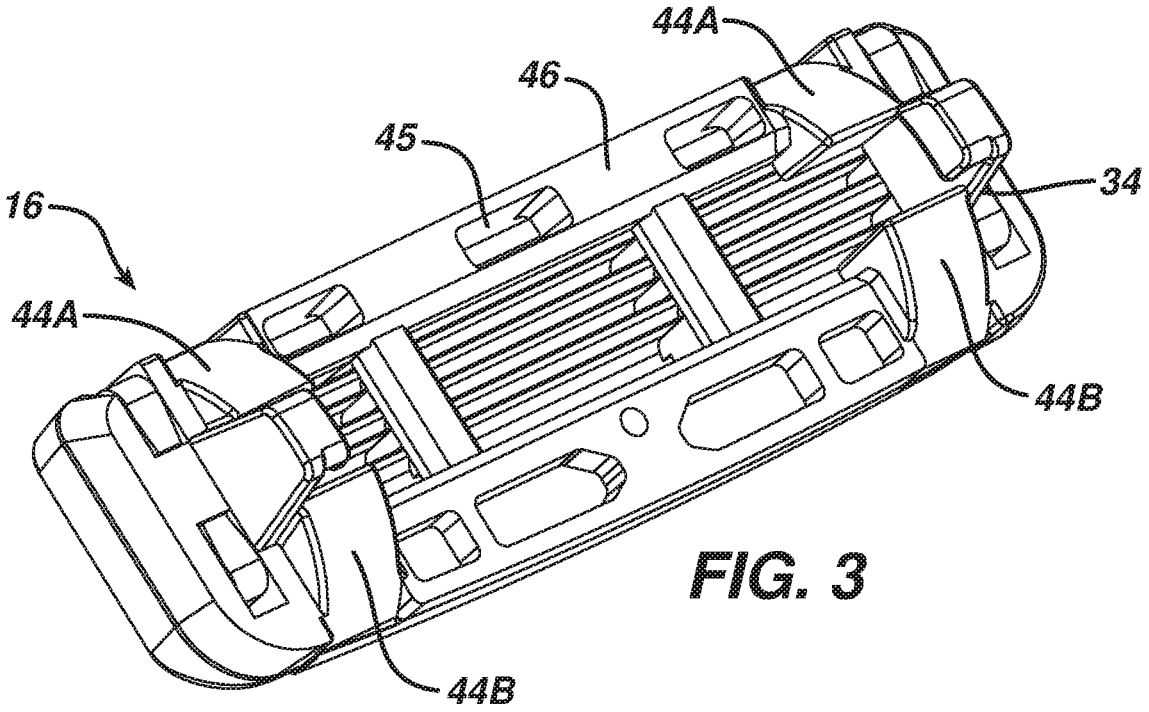
FIG. 3 is a perspective view of the blade unit of the shaving assembly shown in FIG. 2.
Figure 3A:
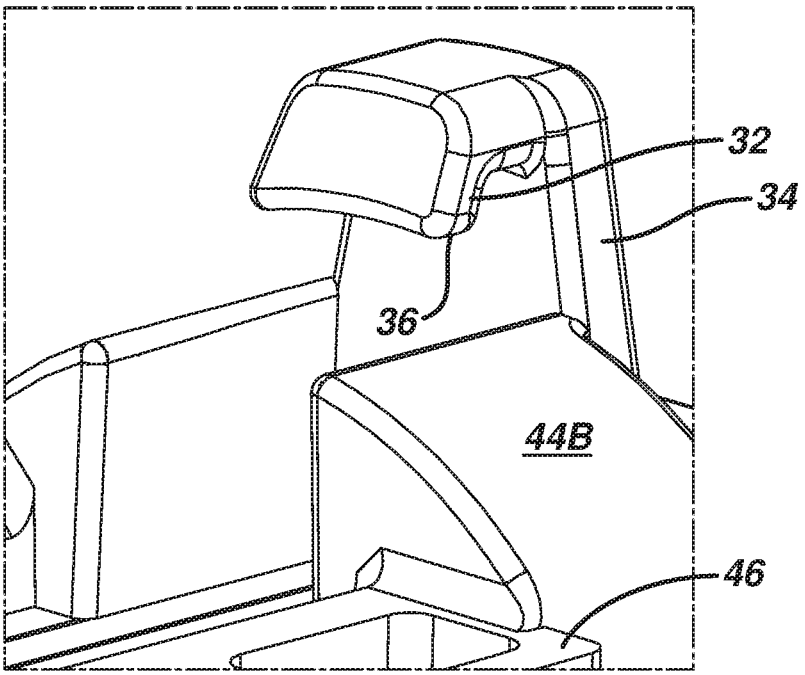
FIG. 3A is an enlarged detail view of an end portion of the blade unit.

Each shell bearing unit includes dual pairs of concentric, arcuate surfaces 44A/44B (FIG. 3-3A) which could be formed as a single, continuous arcuate surface if desired, and 42 (FIG. 4), and 36 and 28 (FIG. 2A.) Each shell bearing unit also includes a hook 32. Shell bearing surfaces 28 and 42 are provided on a shell bearing member 29 disposed at the distal end of an arm 30 extending from the interface element 18 toward the blade unit. Surface 36 is provided on the hook 32, and surface 44 is a surface of the blade unit 16. Hook 32 is provided on a stanchion 34 extending from the blade unit 16 towards the interface element.

Figure 10:
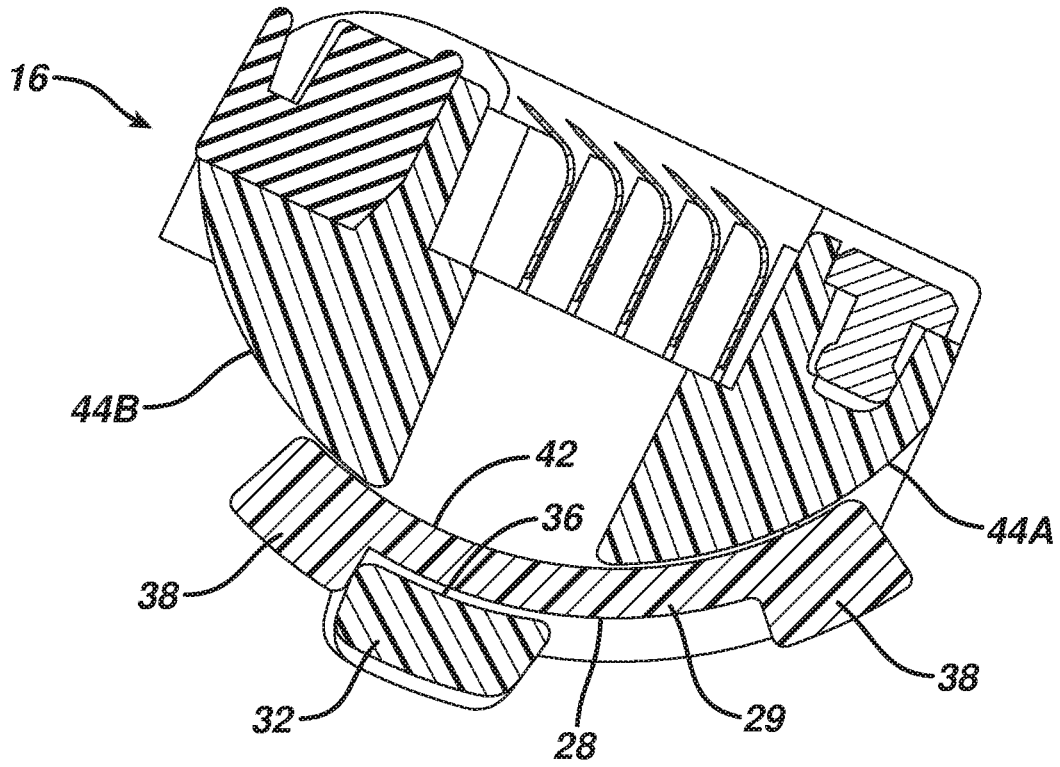
FIG. 10 is similar to FIG. 9, but shows the shaving assembly in a different pivot position.

When shaving loads are applied, shell bearing surface 42 (FIG. 4) rides on blade unit surfaces 44A/44B and a clearance is provided between surfaces 28 and 36. This allows the blade unit 16 to pivot with respect to the interface element 18 to the position shown in FIG. 10. FIG. 10 shows the blade unit fully rotated in the clockwise direction, to the point at which the front surface of hook 32 engages to the rear front surface of flange 38 limiting forward rotation. The pivot angle of the blade unit is limited by front and rear flanges 38 at each end of shell bearing surface 28 (see, e.g., FIGS. 2A and 5.) These flanges interact with the front and rear surfaces of the hook 32 and act as pivot stops. The pivot stops may limit the angle of rotation to any desired extent, e.g., to an angle in the range of about 20 to 70 degrees, e.g., about 30 to 60 degrees.

Figure 9:
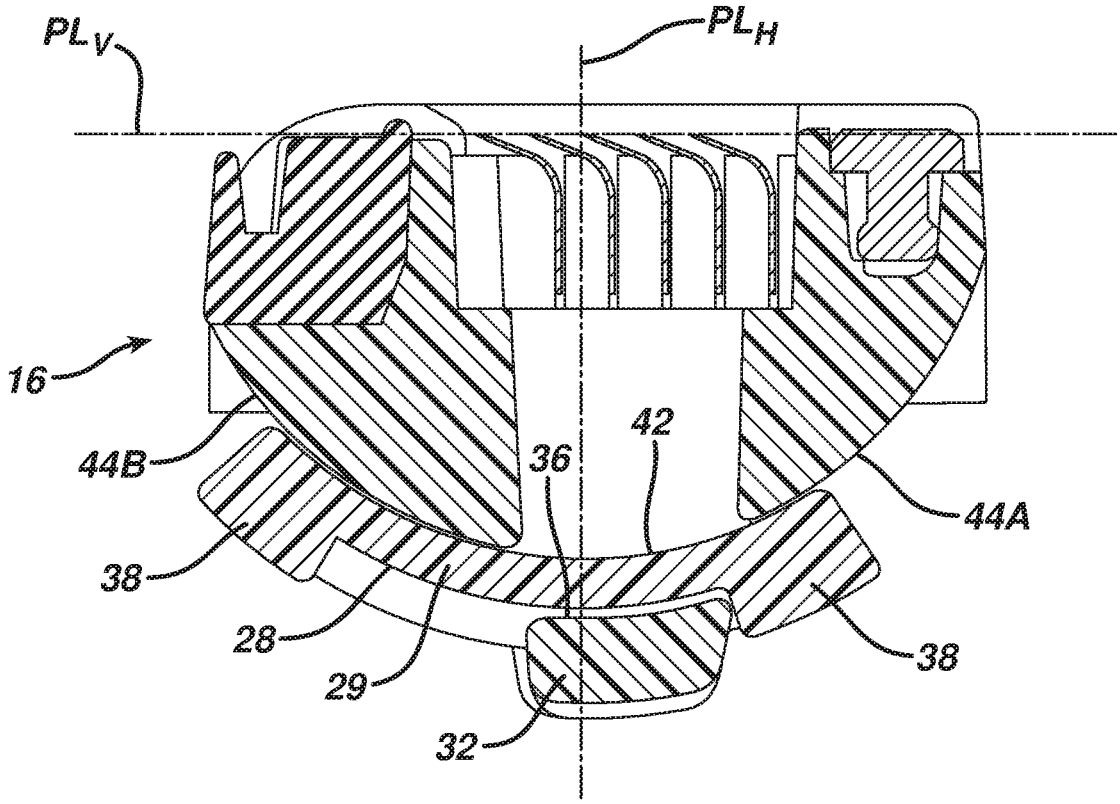
FIG. 9 is a side cross sectional view of the shaving assembly with the vertical pivot location ($PL_V$) and horizontal pivot location ($PL_H$) indicated.

When shaving loads are removed, a spring force, provided by deformation of the return element 22 as a result of pivoting of the blade unit 16 relative to the interface element 18, moves surfaces 36 and 28 into contact and provides a clearance between surfaces 42 and 44A/44B. The elastomeric spring will then move the blade unit back to the rest position as shown in FIG. 9. The only way the blade unit will rotate to the position shown in FIG. 10 is through the interaction of the blade unit with the skin during the shaving process. It is noted that surface 42 should generally be long enough so that the edges of surface 42 do not drop into the gap between surfaces 44A and 44B at any point during rotation.

The interaction of the surfaces 36 on the hooks 32 and the shell bearing surfaces 28 maintains the proximal relationship between the interface element and blade unit when the shaving forces are removed. The rail 40 (FIG. 5) helps locate the blade unit relative to the interface element on the longitudinal axis—however, rail 40 may be omitted if desired because the right hand outside edge of flange 38 (FIG. 2A) contacting the inside left face of stanchion 34 also locates the blade unit relative to the interface element on the longitudinal axis.

Figure 4:
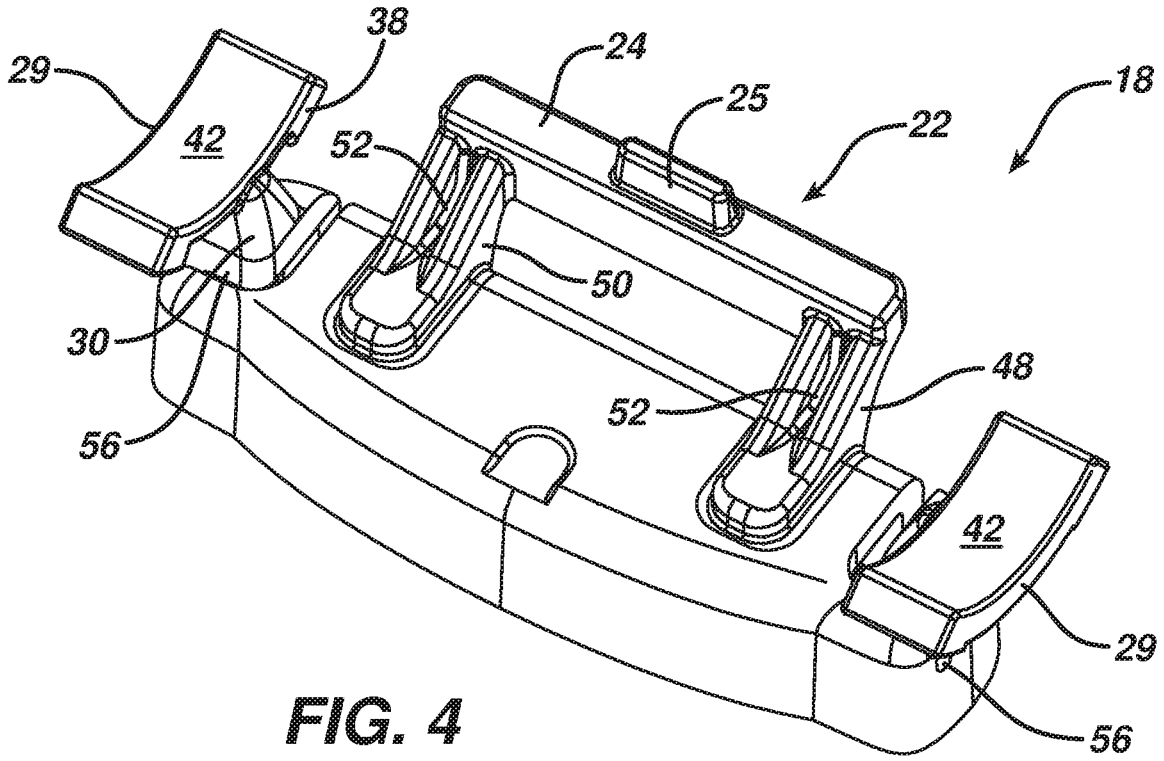
FIG. 4 is a perspective view of the interface element of the shaving assembly shown in FIG. 2.

The elastomeric return element 22, best seen in FIG. 4, includes, as discussed above, a portion 24 that extends generally parallel to the longitudinal axis of the blade unit when the shaving assembly is assembled. The return element 22 is not attached to the blade unit, but rather the portion 24 abuts against a surface of the blade unit. Protrusion 25 (FIG. 4) on the return element 22 fits into opening 45 (FIG. 3) of blade unit 16, to help maintain controlled contact between the return element and blade unit and control the applied spring force. The portion 24, by extending along the length of the blade unit, tends to stabilize the blade unit during pivoting, preventing wobbling of the blade unit.

Portion 24 is supported by side portions 48, 50, which may optionally include channels 52 to provide the side portions with desired flexural properties. During shaving, when the blade unit pivots the side portions 48, 50 go into tension. When the shaving forces are removed, this tension provides a return force that brings the blade unit back to the rest position between cutting strokes. The width and depth of channel 52 can be selected so as to influence the return force provided, with a wider, deeper channel tending to reduce the return force by reducing the wall thickness of side portions 48, 50.

Figure 5:
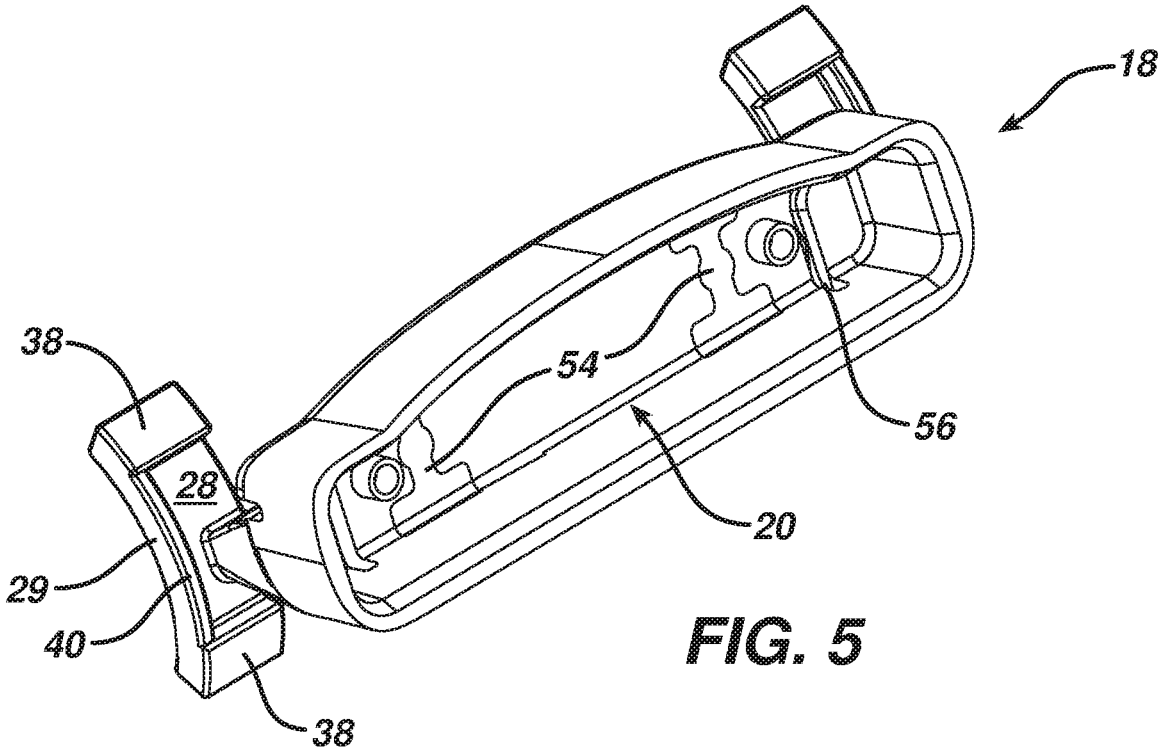
FIG. 5 is a perspective view of the interface element taken from the opposite direction relative to FIG. 4.
Figure 6:
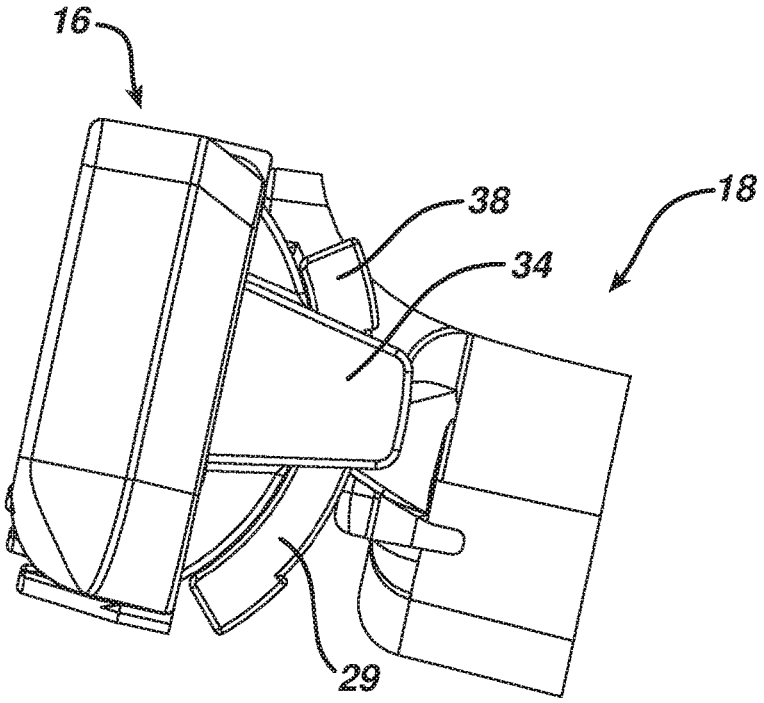
FIG. 6 is a side view of the shaving assembly.
Figure 7:
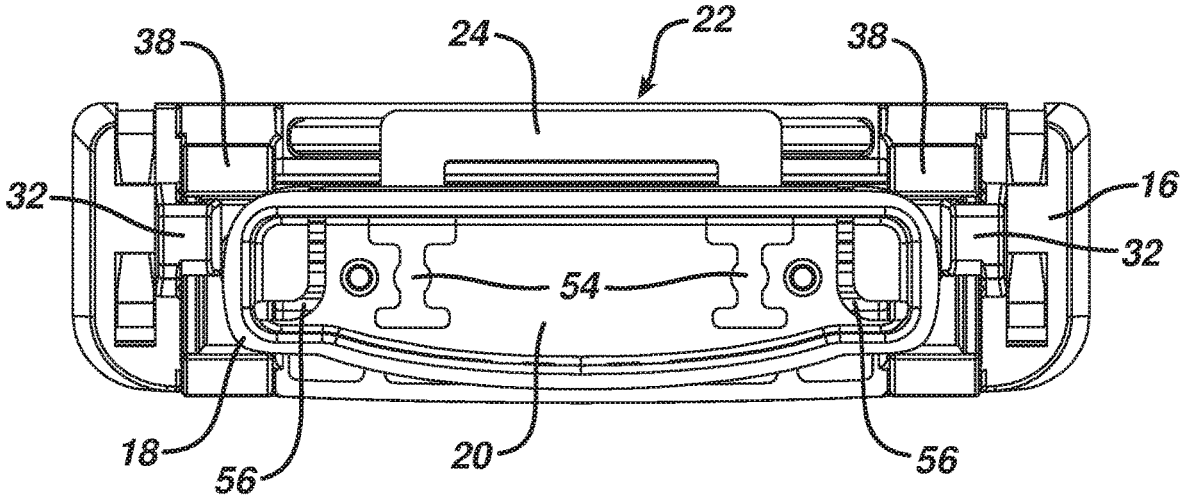
FIG. 7 is a rear view of the shaving assembly.
Figure 8:
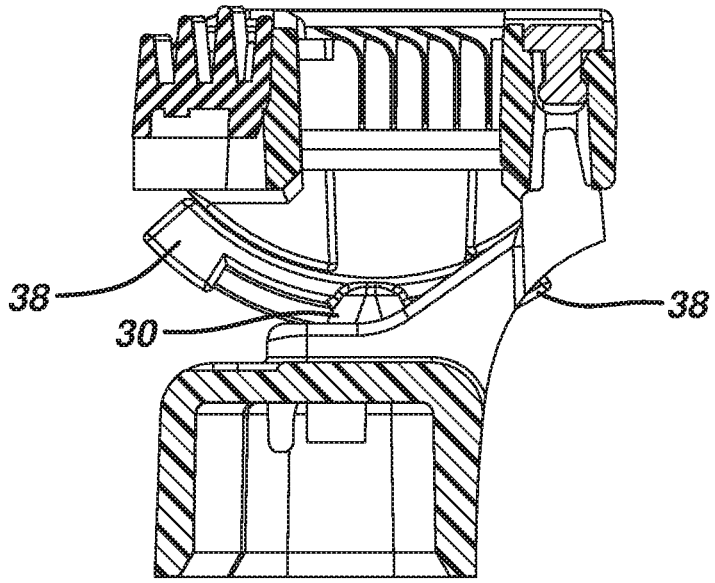
FIG. 8 is a side cross sectional view of the shaving assembly, illustrating the shell bearing assembly in a first pivot position.
Figure 8A:
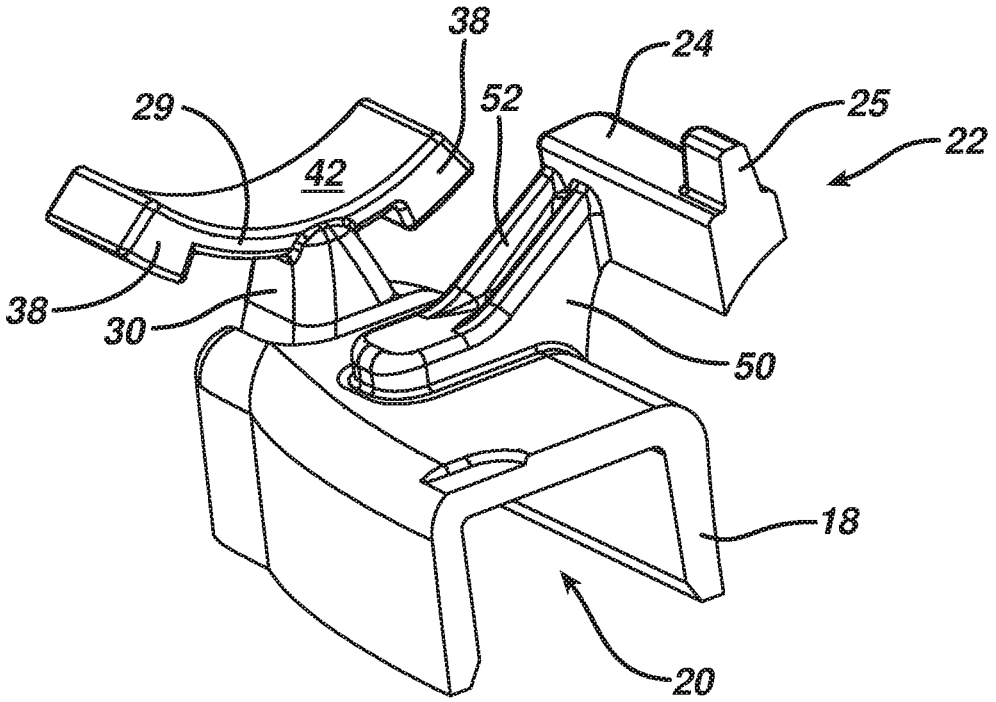
FIG. 8A is a partially cut away perspective view of the interface element.

As shown in FIG. 5, the side portions 48, 50 are anchored in the interface element 18 by anchoring portions 54 which are molded into the material of the interface element.

Referring again to FIG. 4, a channel 56 is provided between each arm 30 and the main body of the interface element to allow the arms to flex slightly inward during assembly, allowing the hook 32 to ride up over ridge 40 and into place on the shell bearing surface 28.

Referring again to FIG. 9, shaving loads are approximately balanced front to back, due to the locations of the horizontal pivot location ($PL_H$) and vertical pivot location ($PL_V$), the intersection of which is the location of the center of concentric pivoting of the shell bearing surfaces. The vertical pivot location runs through the blade plane, where the blade unit contacts the user's skin during shaving, helping to stabilize shaving loads on the blade unit. The horizontal pivot location is roughly in the center of the blade unit, to balance the shaving loads front to back.

Figure 11:
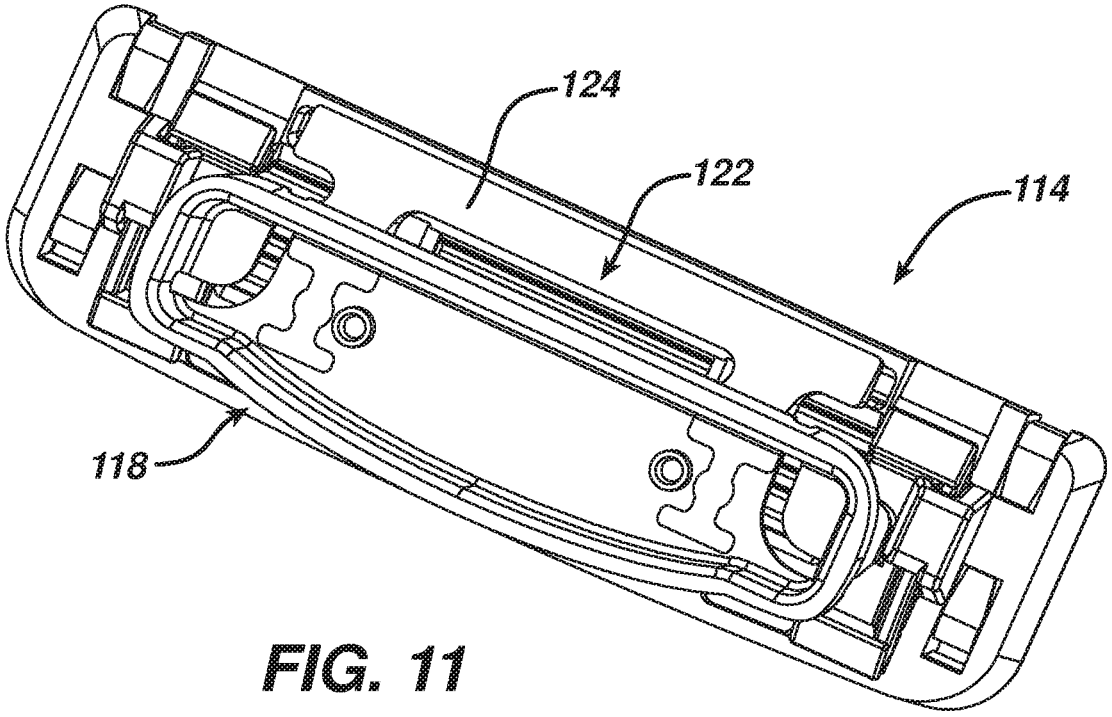
FIGS. 11 and 12 are, respectively, perspective and front plan views of a shaving assembly according to an alternate embodiment.
Figure 12:
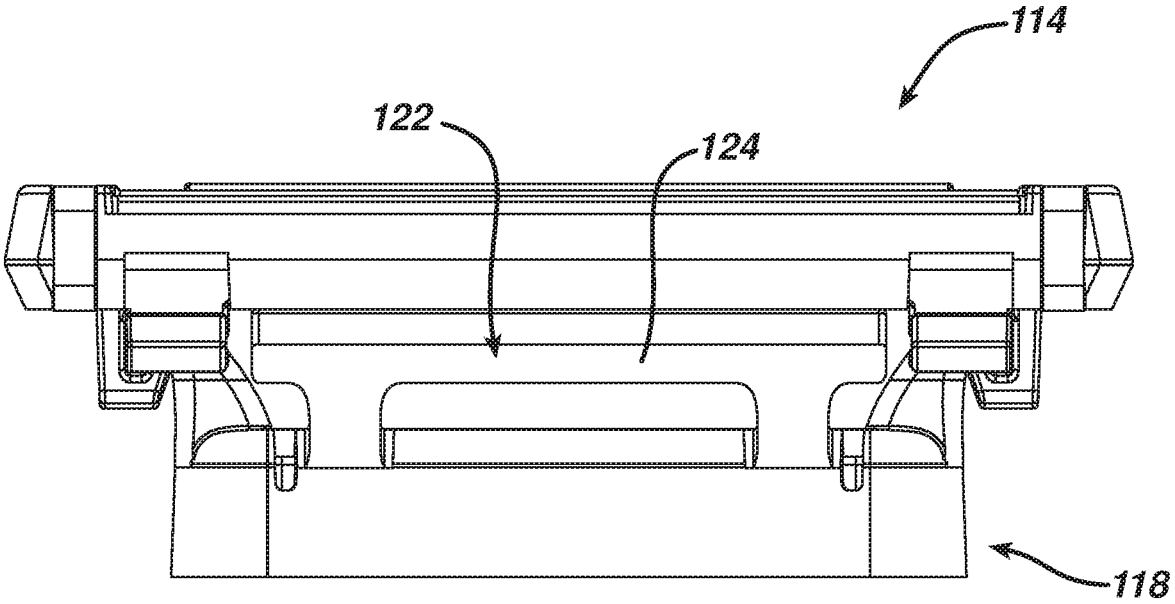
Figure 13:
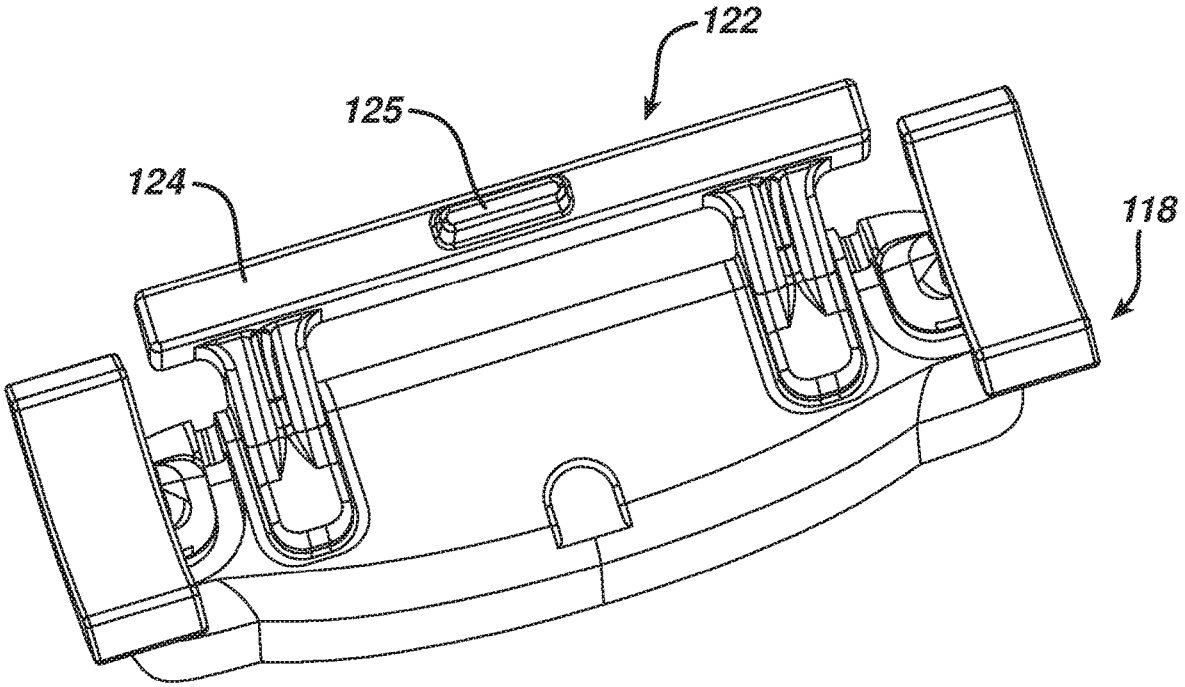
FIG. 13 is a perspective view of the shaving assembly shown in FIG. 11, taken from the opposite direction.
Figure 14:
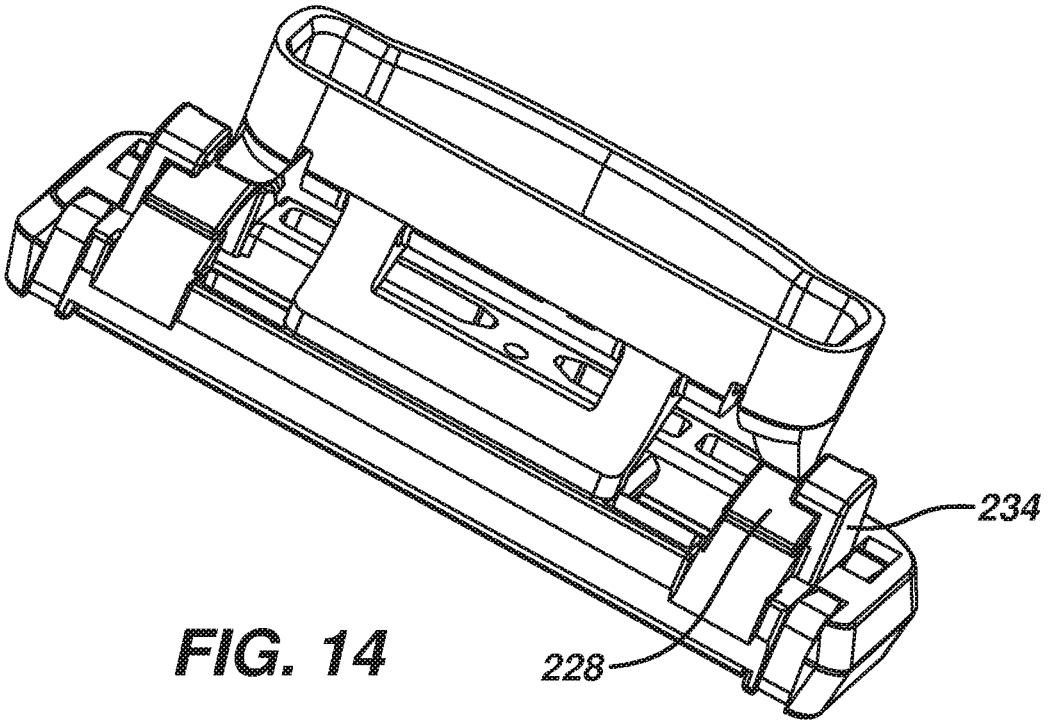
FIG. 14 is a perspective view of a shaving assembly according to another alternate embodiment.
Figure 14A:
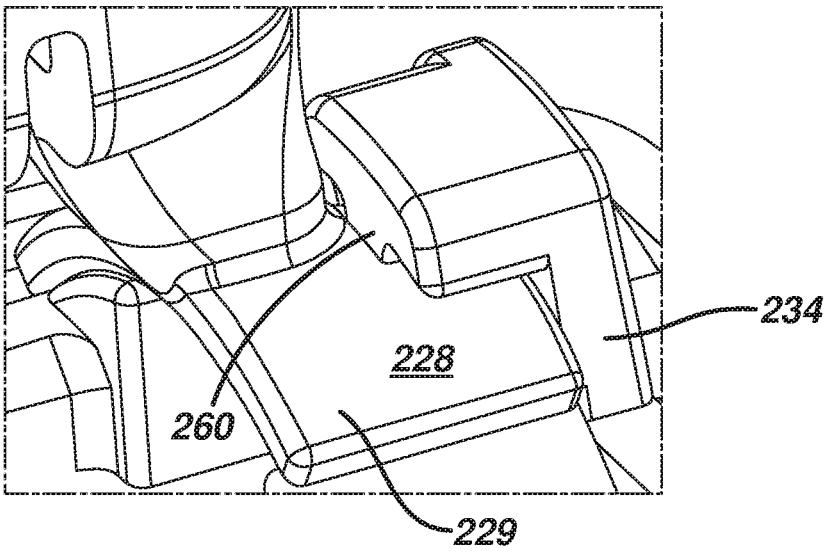
FIG. 14A is an enlarged detail view of an end portion of the shaving assembly shown in FIG. 14.

Referring now to FIGS. 11-13, in an alternate embodiment, a shaving assembly 114 can include an interface element 118 having an elastomeric return element 122 that includes an elongated central portion 124 that extends substantially the entire distance between the shell bearing assemblies. This longer central portion enhances the stabilizing effect of the elastomeric return element, spreading the return force over a larger area and further preventing wobble during shaving.

Other types of mechanical stops may be used to limit rotation of the shell bearing unit. For example, the hook and flanges of the embodiment described above may be replaced by a tooth and slot arrangement as shown in FIGS. 14-22.

Figure 15:
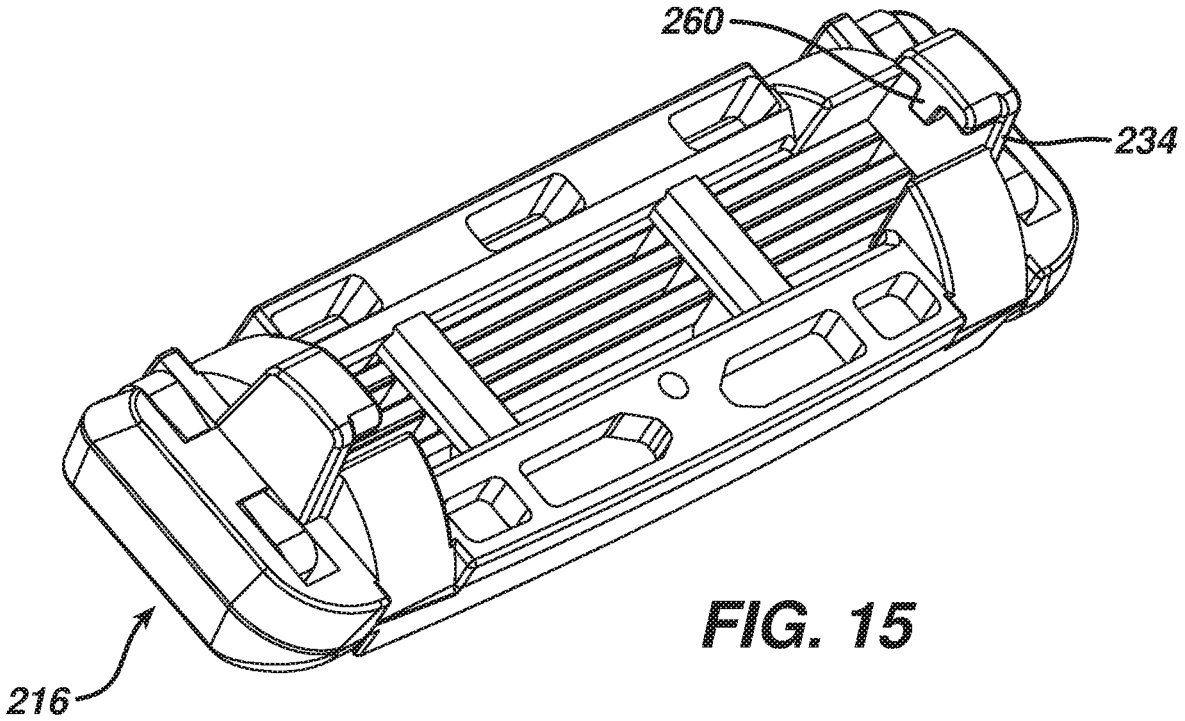
FIG. 15 is a perspective view of an alternate embodiment of the blade unit of the shaving assembly shown in FIG. 14.
Figure 15A:
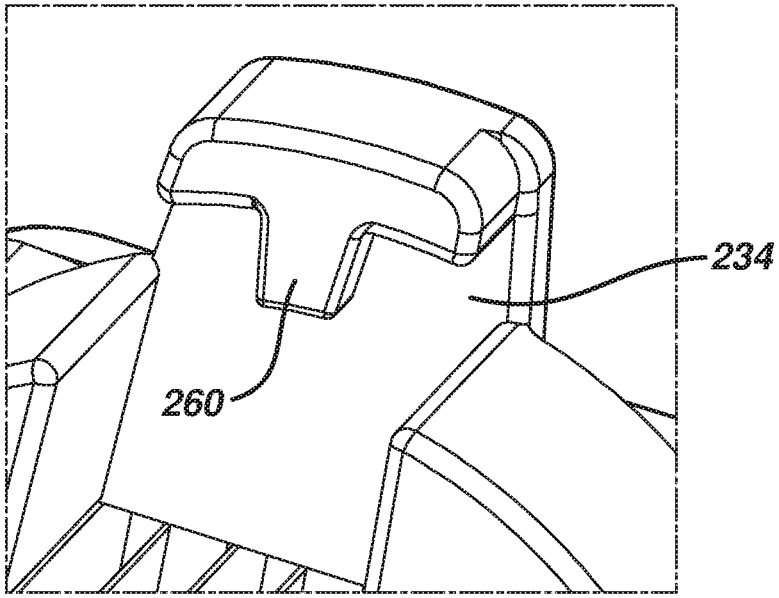
FIG. 15A is an enlarged detail view of an end portion of the blade unit.
Figure 16:
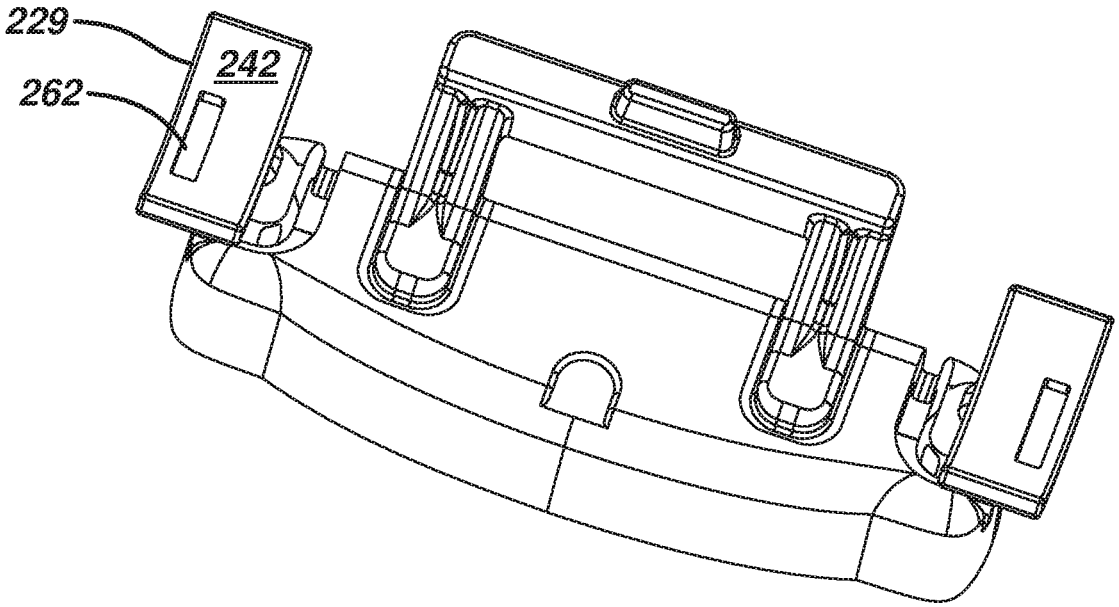
FIG. 16 is a perspective view of the interface element of the shaving assembly shown in FIG. 14.
Figure 17:
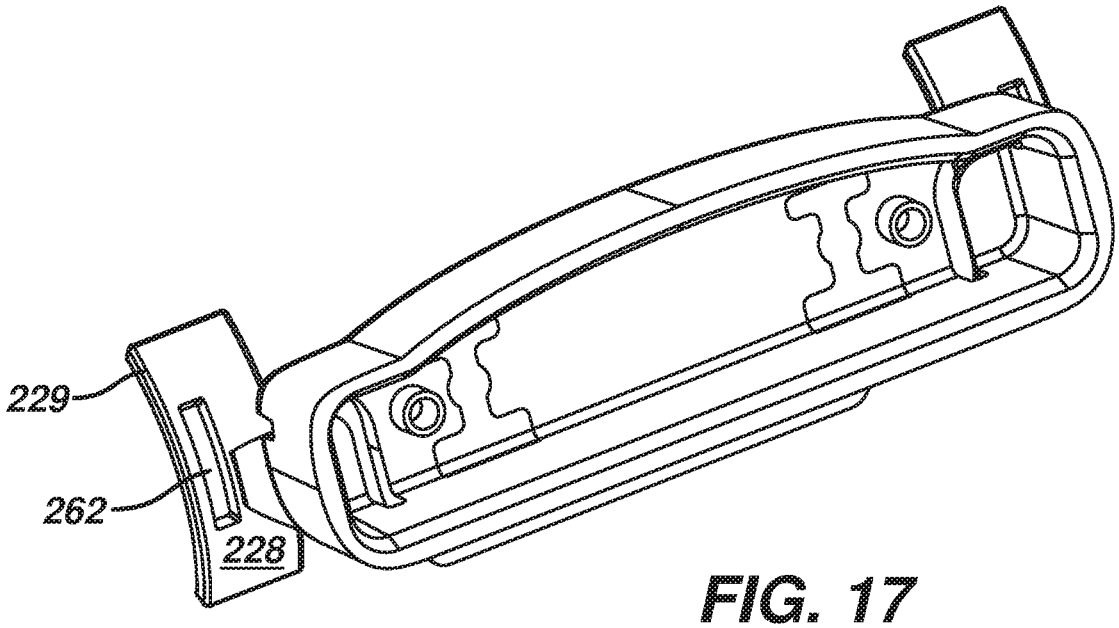
FIG. 17 is a perspective view of the interface element taken from the opposite direction relative to FIG. 16.
Figure 18:
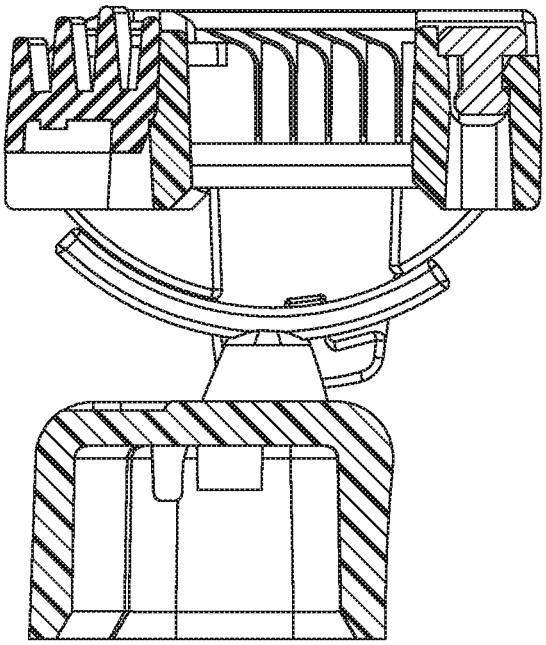
FIG. 18 is a side cross sectional view of the shaving assembly. Illustrating the shell bearing assembly in a first pivot position.
Figure 18A:
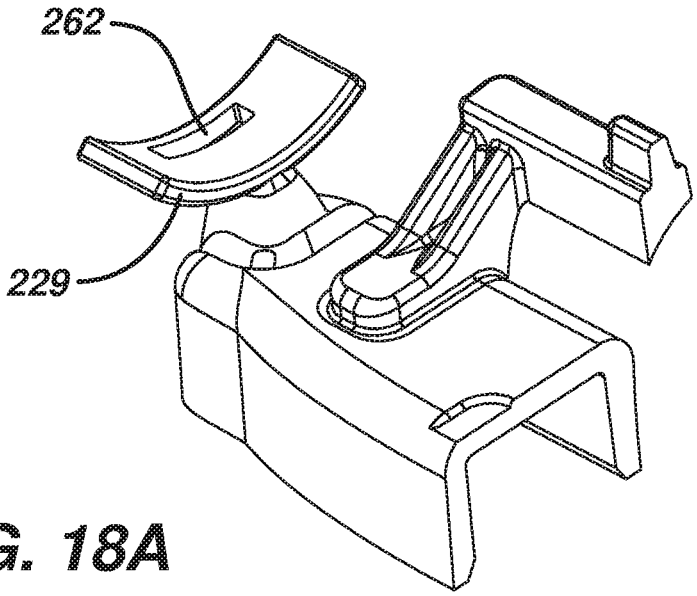
FIG. 18A is a partially cut away perspective view of the interface element.

Referring to FIGS. 15, 15A and 17, in this embodiment the stanchion 234 extending from the blade unit 216 includes a tooth 260 (FIG. 15A) and the shell bearing surface 228 of shell bearing member 229 includes a slot 262 (FIG. 17) which receives the tooth in sliding engagement. In the embodiment shown, slot 262 extends through the shell bearing member 229 to the opposite surface 242. The engagement of the slot and tooth may limit the angle of rotation to any desired extent, for example, to an angle in the range of about 20 to 70 degrees, e.g., about 30 to 60 degrees.

In this implementation, the flanges 38 that were used to limit pivoting in the previous embodiment are not necessary, nor is the ridge that retained the hook in engagement with the shell bearing surface. Instead, the engagement of the tooth with the slot limits pivoting. In all other respects this embodiment is the same as the embodiment described above with respect to FIGS. 1-10.

Figure 19:
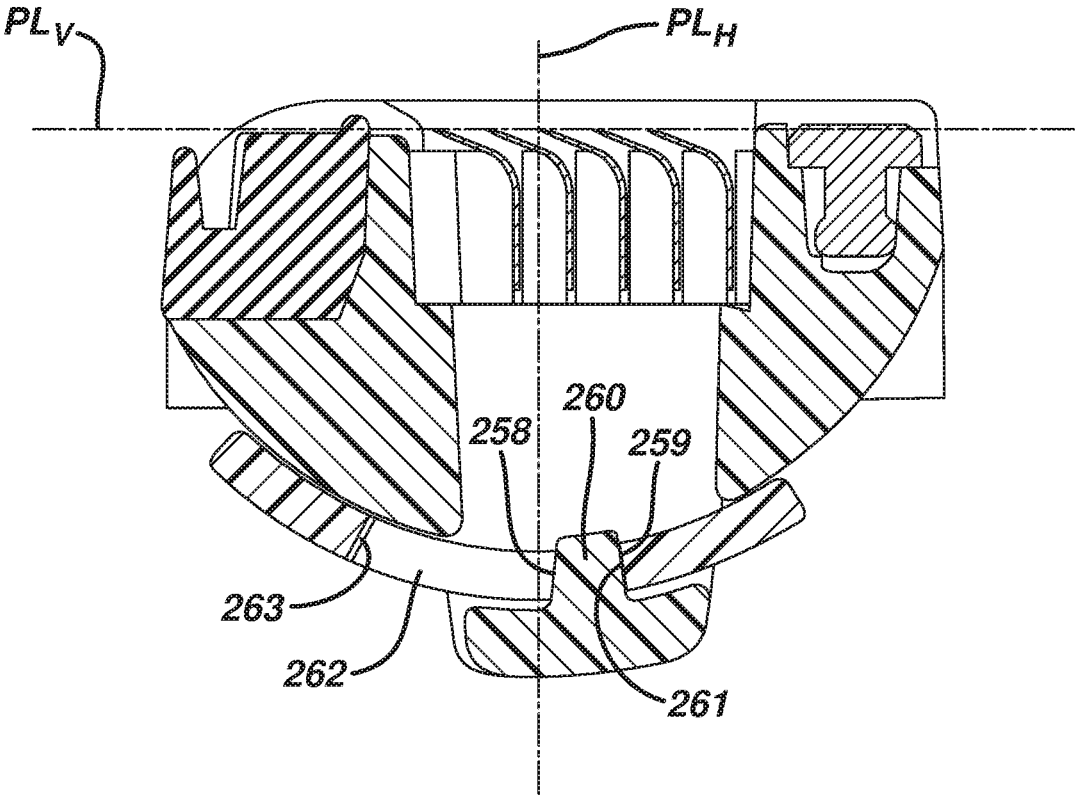
FIG. 19 is a side cross sectional view of the shaving assembly with the vertical pivot location ($PL_V$) and horizontal pivot location ($PL_H$) indicated.
Figure 20:
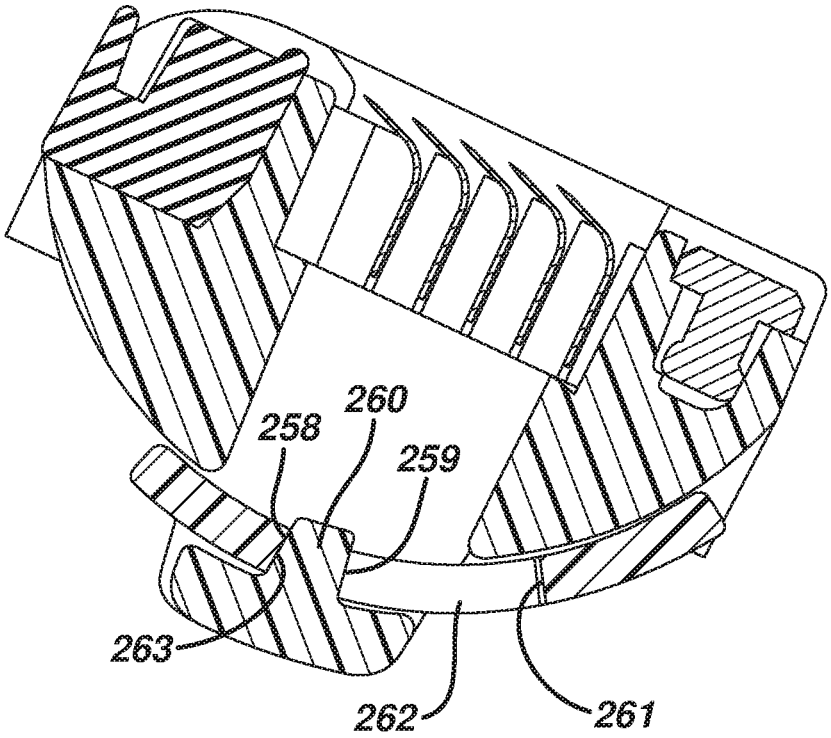
FIG. 20 shows blade unit rotated to a maximum clockwise position, and shows the front rotational tooth stops engaged.
Figure 21:
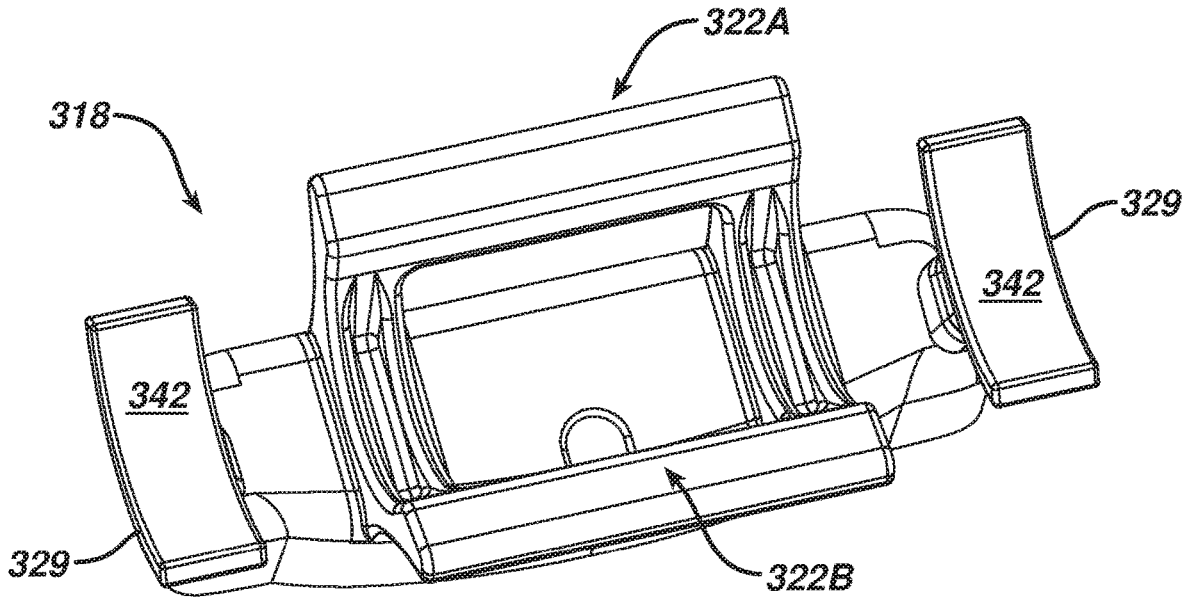
FIG. 21-23 are perspective views, taken from various directions of an interface element according to another alternate embodiment.

Referring to FIGS. 19-20, when the blade unit is in its rest position (FIG. 19) a rear surface 259 of tooth 260 engages a rear surface 261 of slot 262, while when the blade unit is in its maximum forward rotation, i.e., its fully clockwise rotated position (FIG. 20) shows a front surface 258 of tooth 260 engages a front surface 263 of slot 262.

FIGS. 21-24 show several alternative features that can be included in the interface element.

The interface element 318 shown in FIGS. 21-24 includes a pair of opposed elastomeric return elements 322A and 322B. In this embodiment, the two return elements are integrally formed as a single member of the same material, which flows from anchor area 354 as noted above. In preferred implementations, the elastomeric return elements 322A and 322B are constructed so as to balance the spring forces applied to the blade unit 316 front to back. Thus, referring to FIG. 24, distance A is approximately equal to distance B, and distance C is approximately equal to distance D when the blade unit is in its rest position.

Because these distances are approximately equal, the forces applied by the elastomeric return elements 322A and 322B are also approximately equal. As a result, the return elements maintain cartridge balance during shaving. Also, because of the balanced forces, there is no need for mechanical stops (e.g., the flanges or tooth/slot arrangement discussed above) to limit blade unit rotation. Instead, the return elements themselves limit rotation, allowing for a simpler design.

Figure 23:
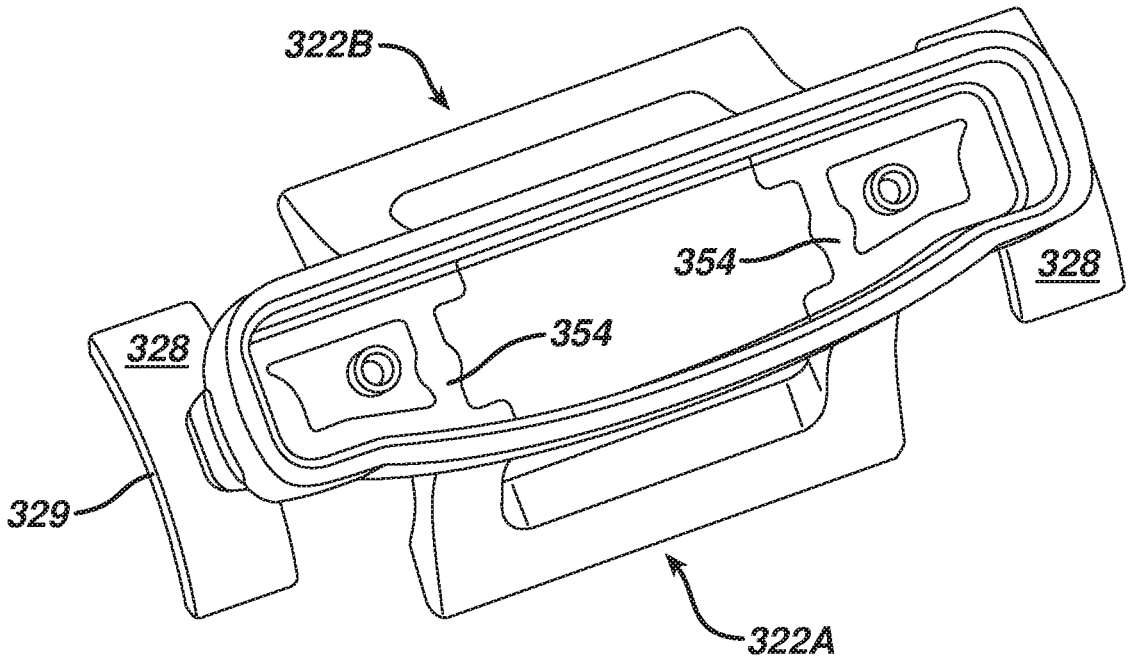
Figure 24:
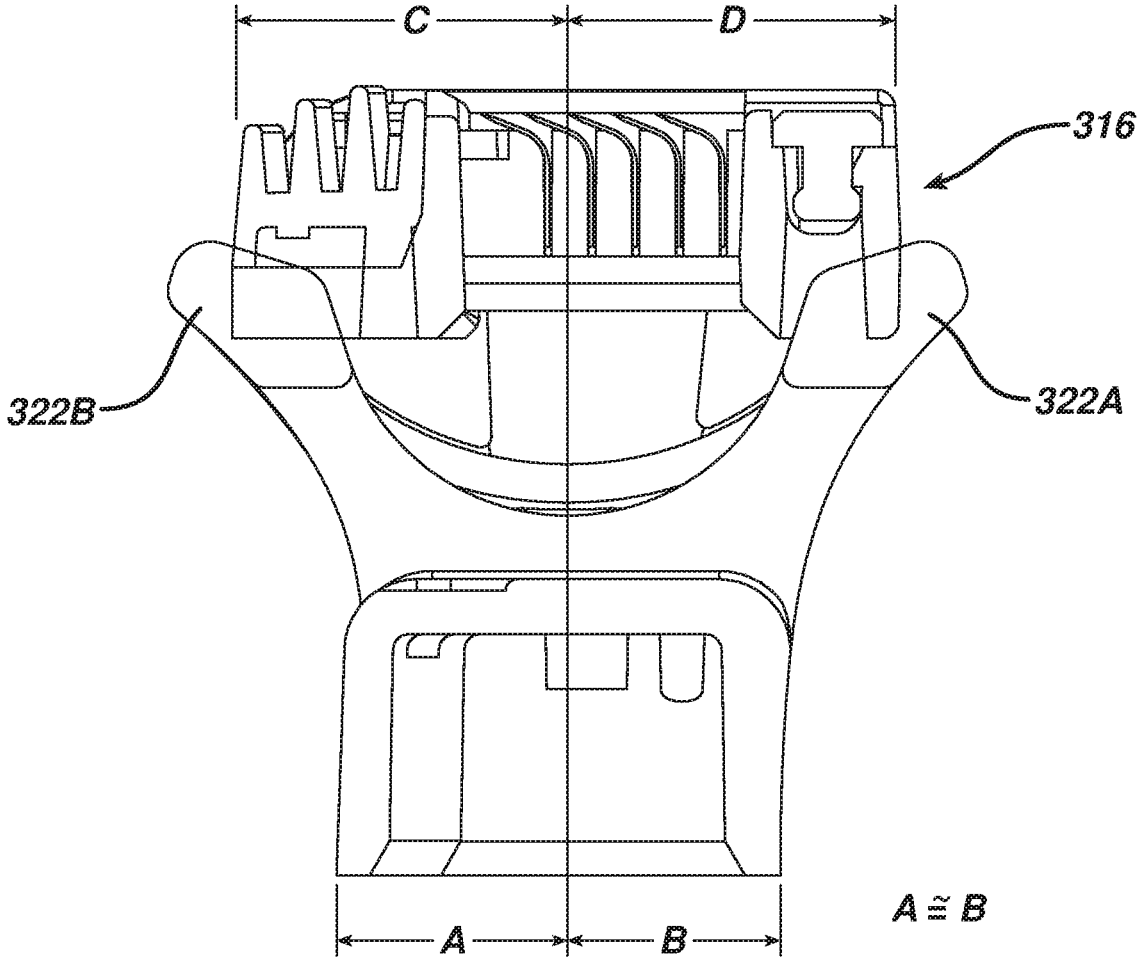
FIG. 24 is a side cross-sectional view of a shaving assembly utilizing the interface element.

Because no mechanical stops are needed, shell bearing surfaces 342 and 328 of shell bearing elements 329 are smooth and continuous, e.g., as shown in FIG. 23.

This simplifies the design and may make assembly and manufacture of the interface element and blade unit easier. The dual spring system may also provide more consistent, wobble-free contact of the blade unit with the skin during shaving, and wobble-free stability of the blade unit between shaving strokes. Stability of the blade unit when it is removed from the skin allows the user to always start the next shaving stroke with same blade unit/handle orientation, i.e., in the neutral position of the blade unit.

Figure 25:
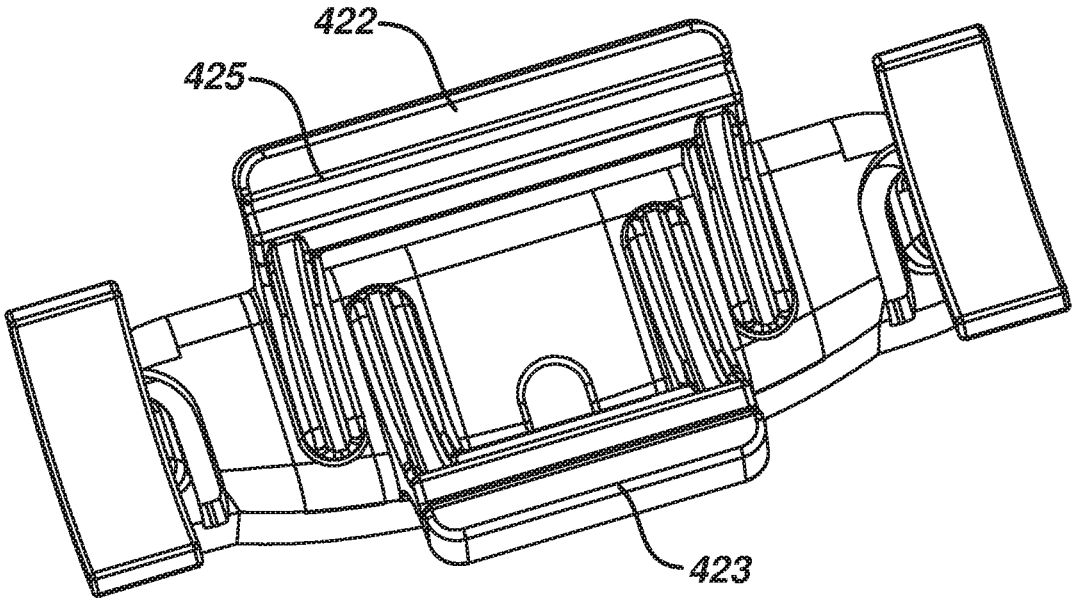
FIG. 25 is a perspective view of an interface element according to another alternate embodiment.
Figure 26:
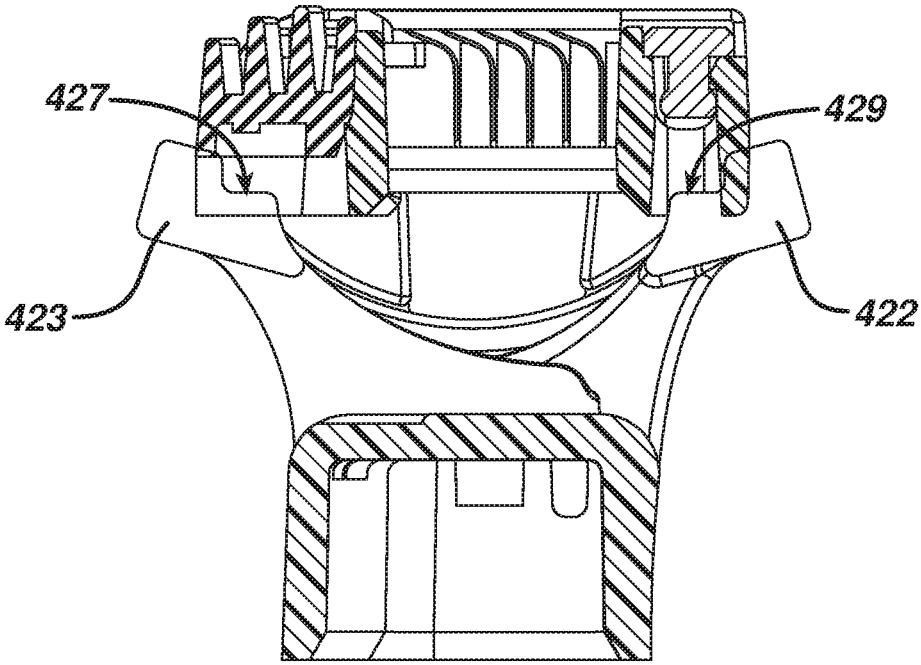
FIG. 26 is a side cross-sectional view of a shaving assembly utilizing the interface element of FIG. 25.

Another alternative embodiment is shown in FIGS. 25-26, in which the two elastomeric return elements 422 and 423 are formed separately. In this case, the elastomeric return elements can be formed of different materials, for example two different elastomers having different durometers and thus different flexural characteristics. The two return elements can also have a different appearance, e.g., have different colors. The two return elements may also have different geometries. For example, in the embodiment shown, return element 422 is longer than return element 423.

Because the two return elements are separate and can thus have different characteristics, the spring forces applied by the return elements can be stronger in one direction than the other. This could be useful for adjusting spring forces, for example to compensate for a front-loaded blade unit. Moreover, the relative spring forces can be changed for different products by utilizing elastomers having different durometers in the return elements, rather than having to modify the geometry of the mold for each razor design.

Figure 26A:
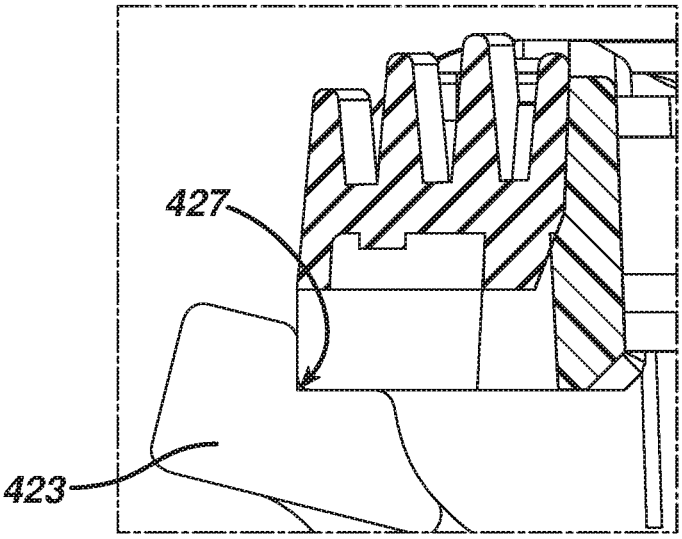
FIGS. 26A and 26B are highly enlarged detail views of the left and right sides, respectively, of the shaving assembly shown in FIG. 26.
Figure 26B:
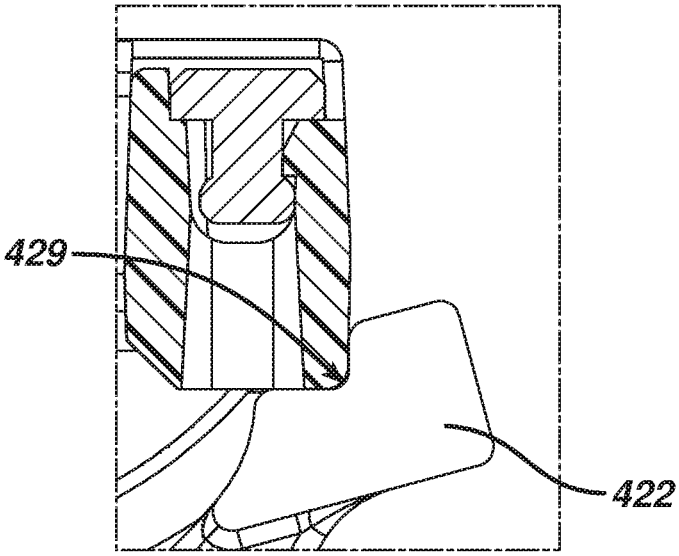

In this embodiment, there is also a notch 427, 429 in each return element that reduces the amount that the return element has to be pushed down by the cartridge in the preloaded state, helping to orient the cartridge appropriately relative to the return elements when preloaded. These notches cradle the front and rear corners of the blade unit housing, as best seen in FIGS. 26A and 26B. These notches can be utilized in the previously discussed embodiments as well as in this embodiment.

Figure 27:
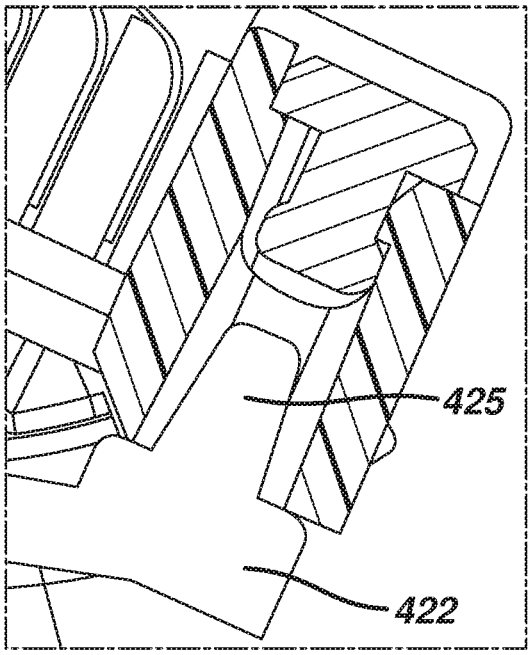
FIG. 27 is an enlarged cross-sectional view of one side of the shaving assembly shown in FIG. 26, taken at the center of the shaving assembly, showing engagement between a portion of the return element and a slot in the blade unit housing.

As shown in FIG. 27, a rib 425 on the return element 422 engages a slot 426 of the blade unit housing, providing a more controlled spring force.

Figure 22:
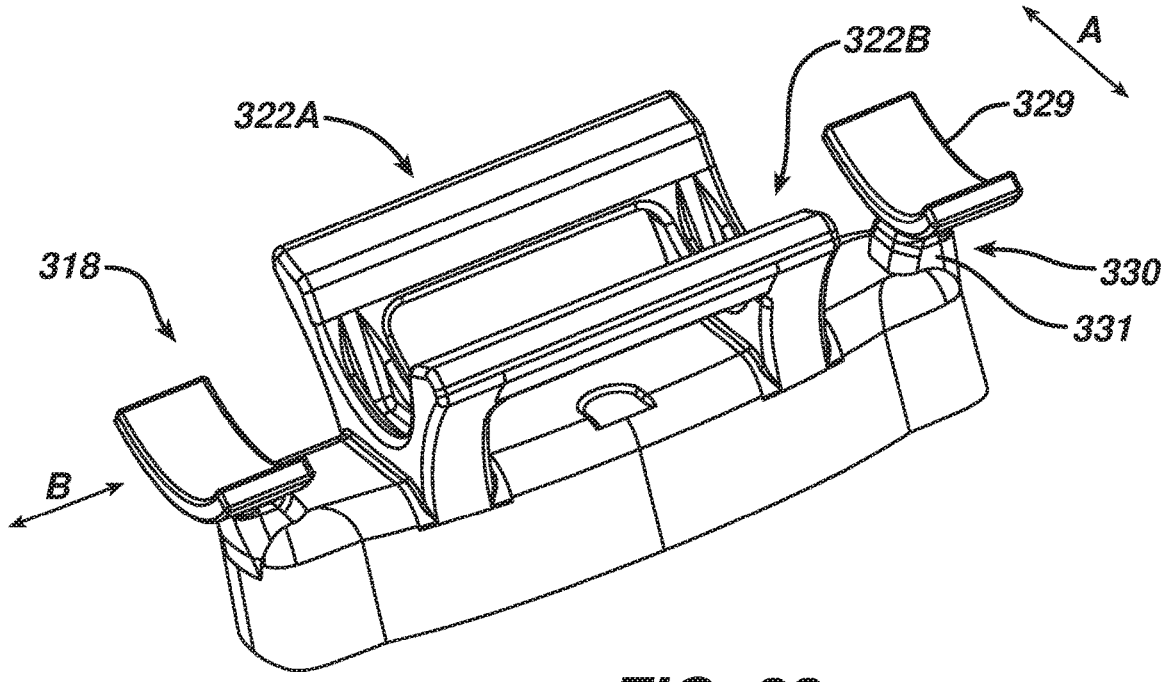
Figure 28:
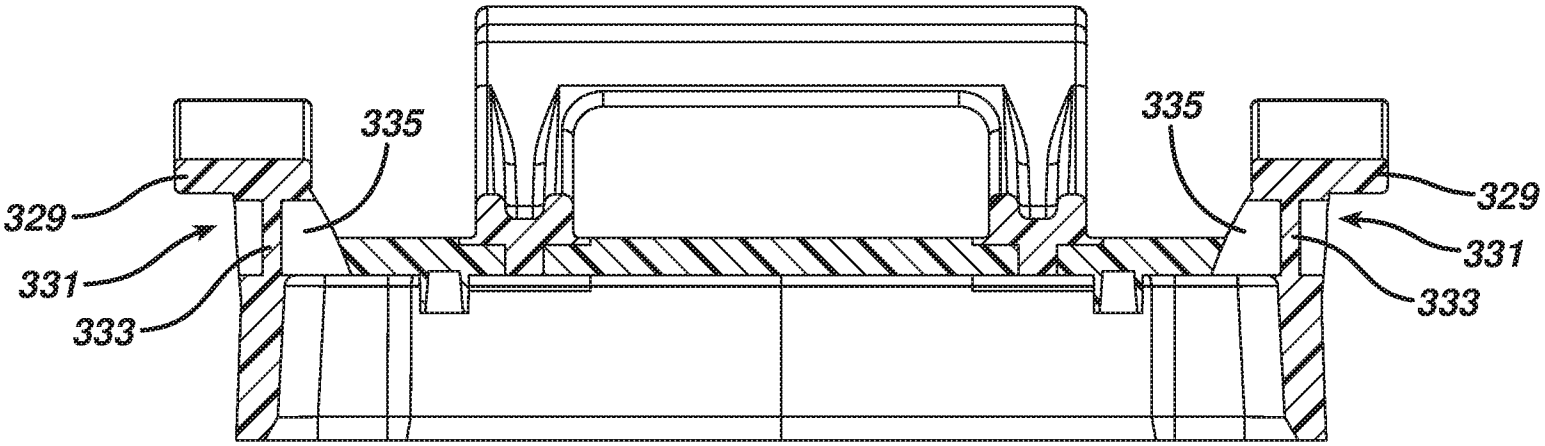
FIG. 28 is a cross-sectional view of the interface element shown in FIGS. 23-25, in which the internal structure of the elastomeric differential flex arm of this embodiment can be seen.
Figure 28A:
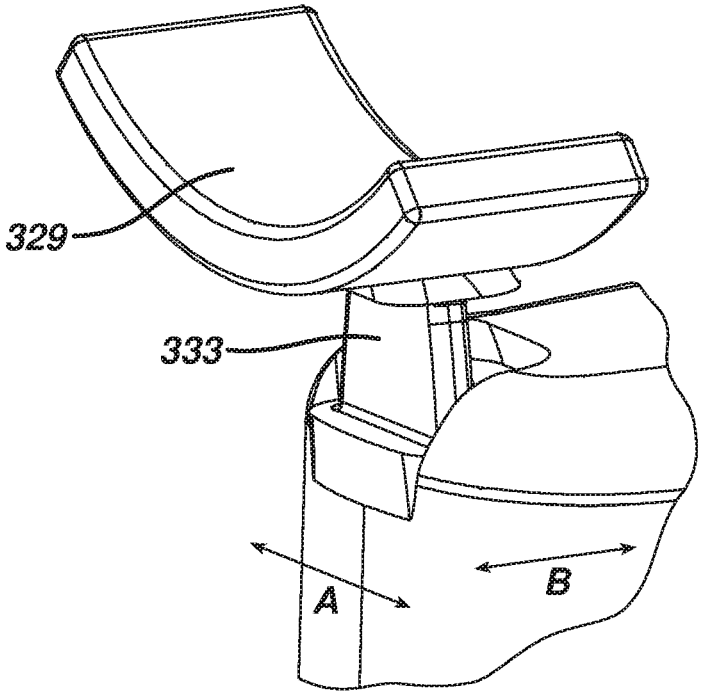
FIG. 28A is an enlarged perspective view of the flex arm with the elastomeric portion removed, showing details of the underlying hard plastic portion of the arm.

As can be seen in FIG. 22, arms 330 are provided with differential elastomeric flex joints 331 at the base of each arm. These differential elastomeric flex joints allow the arms to flex inwardly during assembly, eliminating the need for the channels 56 (FIGS. 4, 5 and 7) that provide this function in the embodiment shown in FIGS. 1-10. The elastomeric flex joints are generally formed of the same elastomer as the elastomeric return elements, which flows from the same anchor region 354 (FIG. 23) within the interface element. As shown in the cross-sectional view in FIG. 28, each of the flex joints 331 includes a generally rectangular internal hard plastic member 333 so that the shell bearing elements 329 can be molded of hard plastic. The hard plastic member 333 also allows the differential elastomeric flex joints 331 to be stiff in a front-to-back direction (arrow A in FIG. 22) to resist shaving forces, but flexible in a side-to-side direction (arrow B in FIG. 22) to aid in assembly of the blade unit onto the interface element during manufacturing. The ability of the arms to flex in direction B also allows for less strict tolerance control during manufacturing. Hard plastic member 333 is surrounded by elastomeric material 335, which supports and protects the hard plastic member 333 during flexing, and provides the flex joint 331 with desired flexural properties. As can be seen in FIG. 28A, the hard plastic member 333 is narrow in the direction parallel to the length of the blades, and wider in the direction perpendicular to the length of the blades. For example, the narrow dimension could be from about 0.3 to 1.0 mm and the wider dimension from about 0.5 to 2.0 mm. The width in the direction perpendicular to the blade length stiffens the arms 331 in direction A to help them resist shaving forces, while the narrowness in the perpendicular direction allows the arms to flex in direction B to aid assembly of the blade unit onto the interface element to form the shaving assembly.

The differential elastomeric flex joints can be used in the embodiment shown in FIGS. 1-10, in place of the channels 56, as well as in the embodiment shown in FIGS. 21-24. The elastomeric flex joints are described in further detail in U.S. Application No. 62/535,006, the full disclosure of which is incorporated by reference herein.

In all of the embodiments discussed above the return element(s) can be formed, for example, from synthetic or natural rubber materials. Suitable materials are well known in the shaving system art, and include thermoplastic elastomers, for example, polyether-based thermoplastic elastomers (TPEs) available from Kraiburg HTP, thermoplastic urethanes (TPUs), silicones, polyether-based thermoplastic vulcanizate elastomer (TPVs) available from Exxon Mobil Corporation under the tradename Santoprene™. The elastomeric material is selected to provide a desired degree of restoring force and durability. In some implementations, the elastomer has a Durometer of less than about 45 Shore A, e.g., from about 20 to 90 Shore A.

The return elements are designed such that their geometry provides an applied load as assembled that is sufficient to return the blade unit to its rest position when not in use, for example, when the handle is being held without any load on the blade unit. Preferably the pretensioned load is typically at least 5 grams, e.g., 5 to 50 grams, and the load during shaving is from about 5 to 100 grams.

The hard portions of the handle, the housing of the blade unit, and the interface element can be made of any suitable material including, for example, metal, acetal (POM), acrylonitrile butadiene styrene (ABS), polyethylene terephthalate (PET or PETE), high density (HD) PETE, high impact polystyrene (HIPS), thermoplastic polymer, polypropylene, oriented polypropylene, polyurethane, polyvinyl chloride (PVC), polytetrafluoroethylene (PTFE), polyester, high-gloss polyester, nylon, or any combination thereof.

Other embodiments are within the scope of the following claims.

What is claimed is:

1. A shaving razor comprising:

a handle having a distal end, a blade unit comprising a plurality of longitudinally extending blades;

mounted on the distal end of the handle, an interface element, configured to removeably connect the blade unit to the handle; and a pair of shell bearing units comprising interacting elements on the interface element and the blade unit that provide pivoting of the blade unit relative to the interface element;

wherein each of the interacting elements comprises a shell bearing element extending from the interface element and having a first arcuate surface, disposed on a stanchion extending from the blade unit towards the interface element, configured to interact with a corresponding first arcuate surface of the blade unit, the shell bearing element including pivot stops to limit relative rotation of the first arcuate surfaces, wherein the pivot stops comprise flanges extending outwardly from the arcuate surface of the shell bearing element, and the stanchion includes a hook on which the first arcuate surface of the blade unit is disposed.

2. A shaving razor comprising:

a handle having a distal end, a blade unit comprising a plurality of longitudinally extending blades;

mounted on the distal end of the handle, an interface element, configured to removeably connect the blade unit to the handle; and a pair of elastomeric return elements extending from the interface element towards the blade unit, each return element having a central portion configured to abut a surface of the blade unit and apply a return force to the surface, the central portion extending generally parallel to a longitudinal axis of the blade unit, and side portions extending from the interface element and supporting the central portion;

wherein the return elements apply opposing, substantially balanced forces to the blade unit to maintain the blade unit in a rest position in the absence of shaving forces.

3. A replaceable shaving assembly comprising:

a blade unit comprising a plurality of longitudinally extending blades;

an interface element, configured to removeably connect the blade unit to a handle;

a pair of shell bearing units comprising interacting elements on the interface element and the blade unit that provide pivoting of the blade unit relative to the interface element;

a first elastomeric return element having a central portion configured to abut a surface of the blade unit and apply a return force to the surface, the central portion extending generally parallel to a longitudinal axis of the blade unit, and side portions extending from the interface element and supporting the central portion; and a second elastomeric return element, configured to apply a force to the blade unit opposing the return force.

4. The shaving assembly of claim 3 wherein the first return element is configured to bias the blade unit towards a rest position with respect to a pivot axis that is generally parallel to the longitudinal axis of the blade unit.

5. The shaving assembly of claim 3, wherein the first return element comprises a synthetic elastomer or natural rubber material.

6. The shaving assembly of claim 3, wherein each of the shell bearing units comprises a shell bearing member extending from the interface element.

7. The shaving assembly of claim 6, wherein each of the shell bearing units further comprises a stanchion extending from the blade unit towards the interface element.

8. The shaving assembly of claim 7, wherein the stanchion comprises a hook, and the shell bearing member includes pivot stop flanges configured to interact with the hook to limit pivoting of the blade unit.

9. The shaving assembly of claim 7, wherein the stanchion comprises a tooth extending towards the shell bearing member, and the shell bearing member includes a slot configured to receive the tooth, interaction between the tooth and the slot limiting pivoting of the blade unit.

10. The shaving assembly of claim 7, wherein the stanchion comprises an elastomeric flex arm.

11. The shaving assembly of claim 10, wherein the elastomeric flex arm includes a core of hard plastic material surrounded by an elastomeric material.

12. The shaving assembly of claim 11, wherein the core has a generally rectangular cross-section.

13. The shaving assembly of claim 4, wherein the first elastomeric return element and the second elastomeric element are integrally formed.

14. The shaving assembly of claim 4, wherein the second elastomeric return element is formed of a different material and/or has a different geometry than the first elastomeric return element.

15. A shaving assembly comprising:

a blade unit comprising a plurality of longitudinally extending blades;

an interface element, configured to removeably connect the blade unit to a handle; and a pair of shell bearing units comprising interacting elements on the interface element and the blade unit that provide pivoting of the blade unit relative to the interface element;

wherein each of the interacting elements comprises a shell bearing element extending from the interface element and having a first arcuate surface, disposed on a stanchion extending from the blade unit towards the interface element, configured to interact with a corresponding first arcuate surface of the blade unit, and wherein the shell bearing element includes pivot stops to limit relative rotation of the first arcuate surfaces, the pivot stops comprising flanges extending outwardly from the arcuate surface of the shell bearing element, and the stanchion includes a hook on which the first arcuate surface of the blade unit is disposed.

16. The shaving assembly of claim 15, wherein the shell bearing element is disposed on an arm extending from the interface element towards the blade unit.

17. The shaving assembly of claim 15, wherein the pivot stops comprise opposite ends of a slot in the first arcuate surface of the shell bearing element, and the stanchion includes a tooth configured to be received in the slot.

18. The shaving assembly of claim 15, wherein each of the interacting elements further comprises a second concentric, arcuate surface, disposed on the shell bearing element, configured to interact with a corresponding second concentric, arcuate surface of the blade unit.

19. A replaceable shaving assembly comprising:

a blade unit comprising a plurality of longitudinally extending blades; an interface element, configured to removeably and pivotably connect the blade unit to a handle; and a pair of elastomeric return elements extending from the interface element towards the blade unit, each return element having a central portion configured to abut a surface of the blade unit and apply a return force to the surface, the central portion extending generally parallel to a longitudinal axis of the blade unit, and side portions extending from the interface element and supporting the central portion;

wherein the return elements apply opposing, substantially balanced forces to the blade unit to maintain the blade unit in a rest position in the absence of shaving forces.

20. The shaving assembly of claim 19, wherein the return elements are integrally formed of a single elastomeric material.

21. The shaving assembly of claim 19, wherein the return elements are formed of two different elastomeric materials.

22. The shaving assembly of claim 19, wherein the central portions of the return elements have different lengths and/or geometries.

23. The shaving assembly of claim 19, wherein the return elements include notches that cradle front and rear edges of the blade unit.

* * * * *